US008270856B2

(12) United States Patent
Mizutani et al.

(10) Patent No.: US 8,270,856 B2
(45) Date of Patent: Sep. 18, 2012

(54) APPARATUS INCLUDING A RE-TRANSFER UNIT TO RE-TRANSFER A RECORDING MEDIUM AND METHOD OF IMAGE FORMING

(75) Inventors: Takehide Mizutani, Sagamihara (JP); Hiroyoshi Haga, Zama (JP); Tsutomu Kato, Kawasaki (JP); Yohhei Watanabe, Sagamihara (JP); Yoshimi Saitoh, Higashi-Ibaraki-gun (JP); Masayoshi Nakayama, Mito (JP)

(73) Assignee: Ricoh Company, Limited, Tokyo (JP)

( * ) Notice: Subject to any disclaimer, the term of this patent is extended or adjusted under 35 U.S.C. 154(b) by 512 days.

(21) Appl. No.: 12/461,479

(22) Filed: Aug. 13, 2009

(65) Prior Publication Data

US 2010/0040386 A1 Feb. 18, 2010

(30) Foreign Application Priority Data

Aug. 13, 2008 (JP) ..... 2008-208321
Jan. 9, 2009 (JP) ..... 2009-003116
Aug. 6, 2009 (JP) ..... 2009-183029

(51) Int. Cl.
*G03G 15/00* (2006.01)
*G03G 15/16* (2006.01)
*G03G 15/20* (2006.01)
*G03G 21/00* (2006.01)

(52) U.S. Cl. ..... 399/44; 399/66; 399/71; 399/309; 399/347

(58) Field of Classification Search ..... 399/44, 399/71

See application file for complete search history.

(56) References Cited

U.S. PATENT DOCUMENTS 5,406,364 A * 4/1995 Maeyama et al. ..... 399/101
5,523,830 A * 6/1996 Tamura et al. ..... 399/297
5,835,831 A * 11/1998 Staudenmayer et al. ..... 399/308
2004/0234284 A1* 11/2004 Boness et al. ..... 399/38
2006/0165974 A1* 7/2006 Ferrar et al. ..... 428/335
2007/0122178 A1* 5/2007 Boness et al. ..... 399/98
2008/0056787 A1* 3/2008 Boness et al. ..... 399/364
2009/0297234 A1* 12/2009 Cahill ..... 399/327
2009/0324264 A1* 12/2009 Boness et al. ..... 399/39

FOREIGN PATENT DOCUMENTS

JP 2004-093999 3/2004
JP 2004-177526 6/2004
JP 3876581 11/2006
JP 2007292920 A * 11/2007

OTHER PUBLICATIONS

Abstract of JP 2001-154508 published on Jun. 8, 2001.

* cited by examiner

*Primary Examiner* — Walter L Lindsay, Jr.
*Assistant Examiner* — David Bolduc
(74) *Attorney, Agent, or Firm* — Harness, Dickey & Pierce, P.L.C.

(57) ABSTRACT

An image forming apparatus is provided, which forms a releasing agent absorption toner image on an in-between printed sides area of a moving surface of an image carrier in the duplex printing mode. When the in-between printed sides area of the moving surface enters a transfer position at which a toner image is transferred from the image carrier to a recording medium, the transferring operation of transferring the toner image from the image carrier to a recording medium is interrupted to keep the releasing agent absorption toner image on the in-between printed sides area of the moving surface of the image carrier.

18 Claims, 9 Drawing Sheets

FIG. 8

TABLE 1

| NO OF DUPLEX PRINTED SHEETS | ENVIRONMENTAL FACTOR | | | |
|---|---|---|---|---|
| | 10°C15% (1. 41) | 23°C50% (10. 30) | 27°C80% (20. 63) | |
| 200 | 5 | 5 | 4.5 | RATE |
| 400 | 5 | 5 | 4 | |
| 800 | 5 | 4.5 | 3 | |

FIG. 9

TABLE 2

| NO OF DUPLEX PRINTED SHEETS | PAPER TYPE | | | |
|---|---|---|---|---|
| | NON-COATED PAPER | MATT COATED PAPER | GLOSS COATED PAPER | |
| 200 | 4.5 | 5 | 5 | RATE |
| 400 | 4 | 4.5 | 5 | |
| 800 | 3 | 4 | 4.5 | |

FIG. 10

TABLE 3

| NO OF DUPLEX PRINTED SHEETS | OIL REMOVAL | | |
|---|---|---|---|
| | NO | YES | |
| 200 | 4.5 | 5 | RATE |
| 400 | 4 | 5 | |
| 800 | 3 | 5 | |

FIG. 11

TABLE 4

| DEFAULT ABSOLUTE HUMIDITY | ENVIRONMENTAL ADJUSTMENT COEFFICIENT (VARIABLE RANGE 0.0 ~ 1.0) |
|---|---|
| LLL ( ~ 2.5) | 0.0 |
| LL (2.5 ~ 5.0) | 0.0 |
| ML (5.0 ~ 8.4) | 0.0 |
| MM (8.4 ~ 15.0) | 0.0 |
| MH (15.0 ~ 24.0) | 1.0 |
| HH (24.0 ~ ) | 1.0 |

FIG. 12

TABLE 5

| PAPER SIZE | BELT WIDTH DIRECTION SIZE (mm) | TRANSFER DIRECTION SIZE (mm) | PAPER SIZE ADJUSTMENT COEFFICIENT |
|---|---|---|---|
| A4Y | 297 | 210 | 2.00 |
| A3T | 297 | 420 | 1.00 |
| A3T | 329 | 483 | 1.00 |
| A4T | 210 | 297 | 1.43 |
| A5T | 149 | 210 | 2.06 |
| A6Y | 148 | 105 | 4.13 |
| B4T | 257 | 364 | 1.16 |
| B5Y | 257 | 182 | 2.32 |
| LT-Y | 279 | 216 | 1.95 |
| DLT | 279 | 432 | 1.00 |
| 13 × 19 inch | 330 | 482 | 1.00 |

FIG. 13

TABLE 6

| | CONDITION 1 | CONDITION 2 | CONDITION 3 |
|---|---|---|---|
| 50K | 5 | 5 | 5 |
| 150K | 5 | 5 | 5 |
| 250K | 5 | 4 | 5 |
| 350K | 5 | 3 | 5 |
| TONER CONSUMPTION | 1 | 1/2 | 2 |

APPARATUS INCLUDING A RE-TRANSFER UNIT TO RE-TRANSFER A RECORDING MEDIUM AND METHOD OF IMAGE FORMING

CROSS-REFERENCE TO RELATED APPLICATIONS

This patent application is based on and claims priority under 35 U.S.C. §119 to Japanese Patent Application Nos. 2008-208321 filed on Aug. 13, 2008, 2009-003116 filed on Jan. 9, 2009, and 2009-183029 filed on Aug. 6, 2009, in the Japanese Patent Office, the disclosure of which is hereby incorporated herein by reference.

FIELD OF THE INVENTION

The present invention generally relates to an apparatus and a method of forming an image on both sides of a recording sheet, and more specifically to an image forming apparatus including a re-transfer unit to re-transfer a recording medium having a toner image fixed thereon that is transferred from a fixing unit to a transfer unit and a method of image forming using the image forming apparatus.

BACKGROUND

In the recent image forming apparatus, a transfer unit is provided, which transfers an image formed on an image carrier such as an intermediate transfer belt onto a recording medium by causing the recording medium to be in contact with the image carrier. The recording medium having the image formed on a first side thereof is transferred to a fixing unit. In order to perform duplex printing, the recording medium that passes the fixing unit is transferred to a re-transfer unit. The re-transfer unit reverses the side of the recording medium, and re-transfers the recording medium to the transfer unit.

The fixing unit, which is provided to heat the recording medium, is usually provided with an oil applying unit that applies oil to a fixing member in order to prevent the toner from being adhered to the surface of the fixing medium. When performing the duplex printing, the recording medium that is sent to the fixing unit for fixing the image onto the first side of the recording medium may absorb the oil on the surface of the fixing member as it passes the fixing member. When the recording medium is re-transferred by the re-transfer unit, the oil absorbed by the recording medium may be transferred to the image carrier or a contact member that is provided near the image carrier such as a transfer roller. The oil transferred to the contact member may be further transferred to the image carrier as the recording medium is transferred from a fixing nip. When more oil is adhered to the image carrier, the amount of toner that is formed on the surface of the image carrier greatly decreases. As a result, an undesired blank section may be observed in the image of the printed recording medium.

The Japanese Patent Application Publication No. 2004-93999 describes an image forming apparatus capable of suppressing the occurrence of a blank section in a printed recording sheet. A plurality of toner images including the yellow toner image, the magenta toner image, the cyan toner image, and the black toner image are sequentially formed on the surface of a photoconductor. The toner images are sequentially transferred to the surface of an intermediate transfer belt functioning as an image carrier to generate a composite toner image. The composite toner image is transferred to a first side of a recording sheet by a transfer device. The recording sheet having the image formed on its first side is transferred to a fixing device to fix the image. The recording sheet having the fixed image formed on its first side is re-transferred to the transfer device by a re-transfer device. The transfer device transfers a composite toner image on a second side of the recording sheet. At this time, the oil adhered to the recording sheet at the time of fixing may be transferred to the intermediate transfer belt from the recording sheet. The oil is removed from the surface of the intermediate transfer belt when the printing job is completed. When the printing job is completed, the image forming apparatus performs oil removal processing to remove the oil from the surface of the intermediate transfer belt. A toner applying device, which is separated from the intermediate transfer belt at the time of performing the printing job, is made in contact with the intermediate transfer belt. The toner applying device includes an applying brush that is rotatably driven, which is made in contact with toner stored in a toner container and the intermediate transfer belt. With this applying brush, the toner is applied to the surface of the intermediate transfer belt. The toner that has been applied to the surface of the intermediate transfer belt absorbs the oil attached to the surface of the intermediate transfer belt. A cleaning device, which is provided to remove residual toner resided on the surface of the intermediate transfer belt after passing the transfer device, is made in contact with the intermediate transfer belt. The toner that has absorbed the oil from the surface of the intermediate transfer belt is scraped off from the surface of the intermediate transfer belt by the cleaning device. As the oil is removed from the surface of the intermediate transfer belt, the occurrence of the blank section in the printed recording sheet may be suppressed.

However, when performing the duplex printing especially for a large number of recording sheets, the above-described image forming apparatus may not be able to suppress the occurrence of the blank section. When the duplex printing job is being performed, the above-described oil removal processing cannot be performed as the applying brush cannot be made in contact with the intermediate transfer belt on which the toner image is formed.

SUMMARY

Example embodiments of the present invention include an image forming apparatus including: an image forming unit to form a toner image on a moving surface of an image carrier at an image forming position; a transfer unit to transfer the toner image formed on the moving surface of the image carrier to a recording medium at a transfer position while causing the recording medium to be in contact with the moving surface of the image carrier; a fixing unit including a fixing member and to fix the toner image on the recording medium while causing the fixing member to be in contact with the recording medium that is transferred from the transfer unit; a re-transfer unit to re-transfer the recording medium transferred from the fixing unit and having the toner image fixed on a first side thereof to the transfer unit after reversing the first side of the recording medium so as to cause a second side of the recording medium to have an image formed and fixed thereon; a cleaning unit including a cleaning member and to clean a portion of the moving surface of the image carrier which has passed the transfer position at which the toner image is transferred by the transfer unit but before enters the image forming position at which the toner image is formed by the image forming unit by causing the cleaning member to be in contact with the portion of the moving surface of the image carrier to remove toner from the portion of the moving surface; and a controller to switch between a single printing mode to form the toner image on the first side of the recording medium, and a duplex printing mode to cause the re-transferring unit to re-transfer the recording medium and form the toner images on both of the first and second sides of the recording medium, according to an instruction received from an operator. The controller causes the image forming unit to form a releasing agent absorption toner image for absorbing the releasing agent on an in-between printed sides area of the moving surface of the image carrier when the instruction received from the operator selects the duplex printing mode. The in-between printed sides area of the moving surface of the image carrier is at least one of: a portion of the moving surface of the image carrier provided between a portion of the surface of the moving image carrier that is made in contact with the first side of the recording medium and a portion of the moving surface of the image carrier that is made in contact with the second side of the recording medium; and a portion of the moving surface of the image carrier provided between a portion of the moving surface of the image carrier that is made in contact with the second side of the recording medium and a portion of the moving surface of the image carrier that is made in contact with a first side of a following recording medium subsequently transferred after the recording medium. When the in-between printed sides area of the moving surface of the image carrier being transferred enters the transfer position, the controller interrupts the transferring operation of transferring the toner image from the image carrier to the recording medium performed by the transfer unit to keep the releasing agent absorption toner image on the in-between printed sides area of the moving surface of the image carrier even after the in-between printed sides area of the moving surface passes the transfer position.

In addition to the above-described example embodiments, the present invention may be practiced in various other ways, for example, as an image forming method performed by the above-described image forming apparatus, or a recording medium storing computer instructions which cause a computer to perform the image forming method.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 8 is a table illustrating the result of performing a blank section test using the image forming apparatus of FIG. 1 when oil removal processing is not performed;

FIG. 9 is a table illustrating the result of performing a blank section test using the image forming apparatus of FIG. 1 when oil removal processing is not performed;

FIG. 10 is a table illustrating the result of performing a blank section test using the image forming apparatus of FIG. 1 when oil removal processing is performed;

FIG. 11 is an environmental adjustment coefficient data table, according to an example embodiment of the present invention;

FIG. 12 is an paper size adjustment coefficient data table, according to an example embodiment of the present invention;

FIG. 13 is a table illustrating the result of performing a blank section test using the image forming apparatus of FIG. 1 when oil removal processing is performed while changing the image forming frequency rate.

Figure 1:
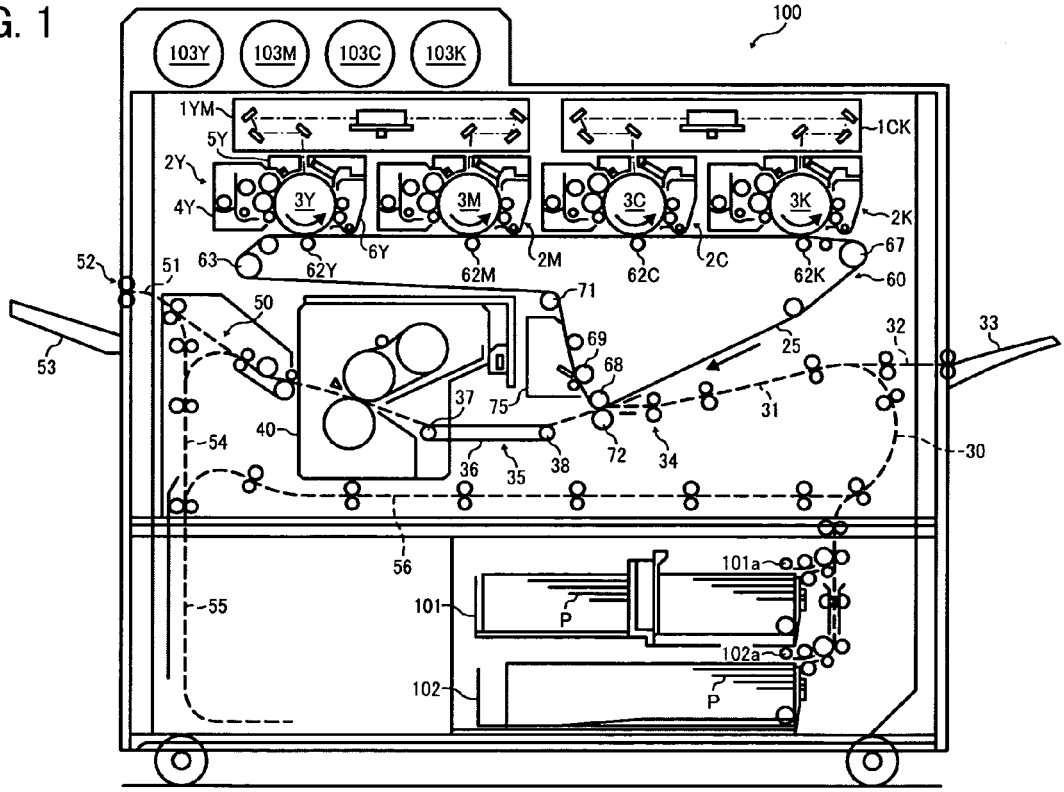
FIG. 1 is a schematic diagram illustrating a structure of an image forming apparatus, according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring now to FIG. 1, a structure of an image forming apparatus 100 is explained according to an example embodiment of the present invention. In this example, the image forming apparatus 100 is implemented by a printer capable of forming an image using the electrophotographic method. For the descriptive purpose, the image forming apparatus 100 may be referred to as the printer 100.

Referring to FIG. 1, the printer 100 includes four process units 2Y, 2M, 2C, and 2K, which respectively form toner images of yellow (Y), magenta (M), cyan (C), and black (K). The printer 100 further includes a sheet feed path 30, a sheet transfer path 31, a manual feed path 32, a manual feed tray 33, a registration roller pair 34, a transfer belt unit 35, an image fixing device 40, a re-transfer unit including a transfer switch device 50, a discharge sheet path 51, a discharge roller pair 52, a discharge sheet tray 53, a first feed cassette 101, a second feed cassette 102, a transfer unit 60. The printer 100 further includes optical writing units 1YM and 1CK. The process units 2Y, 2M, 2C, and 2K are respectively provided with photoconductors 3Y, 3M, 3C, and 3K each having a drum-like shape and functioning as an image carrier.

The first feed cassette 101 and the second feed cassette 102 each store therein a stack of recording sheets P. As a sheet feed roller 101*a* or a sheet feed roller 102*a* is rotatably driven, the recording sheet P placed onto the top of the stack is fed toward the sheet feed path 30. The sheet feed path 30 meets the sheet transfer path 31. The recording sheet P fed from the sheet cassette 101 or 102, which is transferred through the sheet feed path 30, enters the sheet transfer path 31. After entering the sheet transfer path 31, the recording sheet P is transferred to an image forming position at which an image is formed on the recording sheet P.

The printer 100 includes an outer side surface in its main body. The manual feed tray 33 is provided on the outside side surface so as to be rotatable with respect to the outer side surface. When the manual feed tray 33 is rotated away from the outside side surface to be at the open position, a stack of recording sheets P may be placed onto the manual feed tray 33. The recording sheet P placed on the top of the stack is fed by a feed roller pair located near the manual feed tray 33 toward the sheet transfer path 31.

The optical writing units 1YM and 1CK are each provided with a laser diode, polygon mirror, and various lenses. The optical writing units 1YM and 1CK each drive the laser diode according to image data. The image data may be read by a scanner that is provided outside the printer 1 or sent from a personal computer that is provided outside the printer 1. The optical writing units 1YM and 1CK each scan a laser beam onto the surfaces of the photoconductors 3Y, 3M, 3C, and 3K of the process units 2Y, 2M, 2C, and 2K. More specifically, as illustrated in FIG. 1, the photoconductors 3Y, 3M, 3C, and 3K of the process units 2Y, 2M, 2C, and 2K are each rotatably driven in the counterclockwise direction by a driving device. The optical writing unit 1YM scans the laser beam toward the surfaces of the photoconductors 3Y and 3M that are rotated by deflecting the light beam in the direction of the rotational axes of the photoconductors 3Y and 3M. As the laser beam is scanned, the electrostatic latent images are formed respectively on the surfaces of the photoconductors 3Y and 3M according to the Y image data and the M image data. The optical writing unit 1CK scans the laser beam toward the photoconductors 3C and 3K that are rotated by deflecting the light beam in the direction of the rotational axes of the photoconductors 3C and 3K. As the laser beam is scanned, the electrostatic latent images are formed respectively on the surfaces of the photoconductors 3C and 3K according to the C image data the K image data.

In each of the process units 2Y, 2M, 2C, and 2K, the photoconductor 3Y, 3M, 3C, or 3K functioning as the image carrier and the peripheral devices that are arranged near and provided for the photoconductor 3Y, 3M, 3C, or 3K are supported by one common supporter such that these devices are incorporated into one unit. These process units 2Y, 2M, 2C, and 2K are removable from or attachable to the body of the printer 1. Further, except for the color of the toner for use, the process units 2Y, 2M, 2C and 2K are substantially similar in mechanical structure. For example, in the process unit 2Y provided for the Y color image, a developing device 4Y is provided in addition to the photoconductor 3Y, which develops the electrostatic latent image formed on the surface of the photoconductor 3Y onto a toner image of Y color. The process unit 2Y further includes a charging device 5Y that uniformly charges the surface of the photoconductor 3Y as it rotates, and a cleaning device 6Y that removes residual toner resided on the surface of the photoconductor 3Y after the image is transferred.

As illustrated in FIG. 1, the process units 2Y, 2M, 2C, and 2K have a tandem type structure such that they are arranged side by side in the rotating direction of an intermediate transfer belt 25 (FIG. 1) functioning as an endless belt.

The photoconductor 3Y, which has a drum-like shape, may be made of aluminum core that is covered by a photosensitive layer applied with organic photosensitive material having the photosensitivity. Alternatively, the photoconductor 3Y may be made of an endless belt.

The developing device 4Y develops the electrostatic latent image into the toner image using a developer. In this example, the developer is a two-component developer including the magnetic carrier and the non-magnetic yellow toner. Alternatively, the developer may be implemented by a one-component developer, which does not include the magnetic carrier. The developer device 4Y may be supplied with the yellow toner at any desired time from a Y toner bottle 103Y through a yellow toner supplying device.

The cleaning device 6Y is implemented by a rotatable fur brush that is made in contact with the photoconductor 3Y for improved cleaning capability. The cleaning device 6Y, which is the fur brush, scratches off a lubricant powder from a solid lubricant, and applies the lubricant powder to the surface of the photoconductor 3Y. Alternatively, the cleaning device 6Y may be implemented by a cleaning blade made of polyurethane rubber, which is pressed against the photoconductor 3Y.

The process unit 2Y further includes a discharge device such as a discharge lamp provided above the photoconductor 3Y. The discharge device discharges the surface of the photoconductor 3Y by irradiating the light beam thereon when the surface of the photoconductor 3Y passes the cleaning device 6Y. After being discharged, the surface of the photoconductor 3Y is uniformly charged by the charging device 5Y to receive the light beam scanned by the optical writing unit 1YM. The charging device 5Y is rotatably driven when it is supplied with a charging bias from a power supply unit. Alternatively, the charging device 5Y may be implemented by a scorotron charger, which charges the surface of the photoconductor 3Y while not contacting the surface of the photoconductor 3Y.

As described above, the process units 2M, 2C, and 2K are similar in mechanical structure with the process unit 2Y.

The transfer unit 60 is provided below the process units 2Y, 2M, 2C, and 2K. The transfer unit 60 includes the intermediate transfer belt 25, which functions as an image carrier and stretches over a plurality of rollers including a drive roller. The intermediate transfer belt 25, which is in contact with the surfaces of the photoconductors 3Y, 3M, 3C, and 3K, is rotated and transferred by the drive roller in the clockwise direction. The nips formed by the intermediate transfer belt 25 and the surfaces of the photoconductors 3Y, 3M, 3C, and 3K are referred to as the primary transfer nips.

At the primary transfer nips, a plurality of primary transfer rollers 62Y, 62M, 62C, and 62K are respectively provided within the inside of the loop formed by the intermediate transfer belt 25 to press the intermediate transfer belt 25 against the photoconductors 3Y, 3M, 3C, and 3K. The primary transfer bias power, which is supplied by a power supply unit, is applied to each of the primary transfer rollers 62Y, 62M, 62C, and 62K. With this primary transfer bias power, the primary transfer electric fields are generated that cause the toner images formed on the surfaces of the photoconductors 3Y, 3M, 3C, and 3K to transfer toward the intermediate transfer belt 25.

As the intermediate transfer belt 25 moves in the clockwise direction and sequentially passes the primary transfer nips, the toner images of yellow, magenta, cyan, and black are sequentially transferred onto the surface of the intermediate transfer belt 25 at the primary transfer nips. As a result, a composite toner image of four colors is formed on the surface of the intermediate transfer belt 25.

Still referring to FIG. 1, the printer 100 includes a secondary transfer roller 72 provided below the intermediate transfer belt 25 at the position that faces a secondary transfer back-up roller 68 while contacting the surface of the intermediate transfer belt 25 to form a secondary transfer nip. The secondary transfer back-up roller 68, which is provided inside the loop formed by the intermediate transfer belt 25, is made in contact with the secondary transfer roller 72 via the intermediate transfer belt 25.

The secondary transfer bias power, which is supplied from a power supply unit, is applied to the secondary transfer roller 72 to form a secondary transfer electric field at the secondary transfer nip.

The registration roller pair 34, which is provided at the right side of the secondary transfer nip, feeds the recording sheet P that passes through the nip formed by the roller pair 34 toward the secondary transfer nip at the timing such that the composite toner image formed on the intermediate transfer belt 25 can be transferred to the recording sheet P at the secondary transfer nip. At the secondary transfer nip, the composite toner image formed on the intermediate transfer belt 25 is transferred to the recording sheet P by the secondary transfer electric field and the nip pressure to generate the recording sheet P formed with the full-color image.

The surface of the intermediate transfer belt 25 after passing the secondary transfer nip may have residual toner that is not transferred to the recording sheet P. The residual toner is removed by a belt cleaning device 75 that contacts the intermediate transfer belt 25.

The recording sheet P after passing the secondary transfer nip is transferred away from the intermediate transfer belt 25 toward a transfer belt unit 35. The transfer belt unit 35 includes an endless transfer belt 36, which stretches over a drive roller 37 and a driven roller 38 and is rotatably driven in the counter clockwise direction by the rotation of the drive roller 37. The transfer belt 36 transfers the recording sheet P transferred from the secondary transfer nip toward the fixing device 40.

Figure 2:
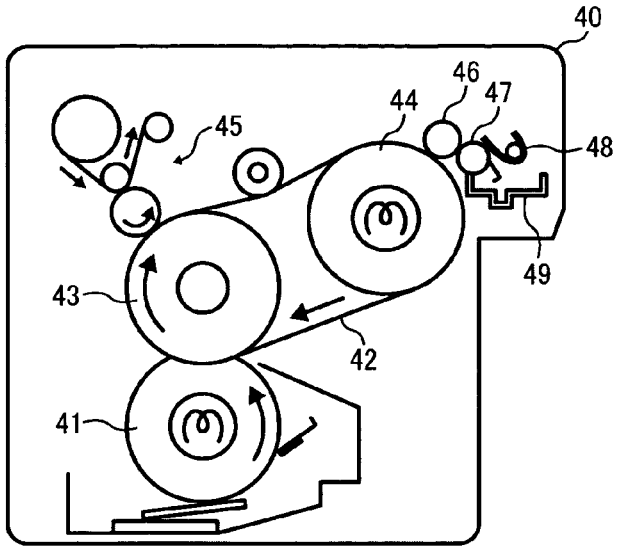
FIG. 2 is a schematic cross-sectional diagram illustrating an enlarged section of a fixing unit provided in the image forming apparatus of FIG. 1, according to an example embodiment of the present invention.

Referring to FIG. 2, the fixing device 40 includes a fixing roller 41, a fixing belt 42, an elastic drive roller 43, a heating roller 44, a toner removal unit 45, an oil applying roller 46, an oil supplying roller 47, an oil penetration felt 48, and an oil receptor plate 49.

The heating roller 44 incorporates therein a heating element such as a halogen lamp. The fixing belt 42, which is an endless belt, stretches over the elastic drive roller 43 and heating roller 44 and rotates in the clockwise direction as the elastic drive roller 43 rotates in the direction indicated by the arrow illustrated in FIG. 2. At the position contacting the heating roller 44, the surface of the fixing belt 42 is heated. The on or off of the heating element of the heating roller 44 may be controlled by a fixing temperature controller section. For example, the fixing temperature controller section may control on or off of the heating element based on a detection result obtained by a temperature sensor that detects the surface temperature of the fixing belt 42 so as to keep the surface of the fixing belt 42 to be a predetermined value.

Figure 14:
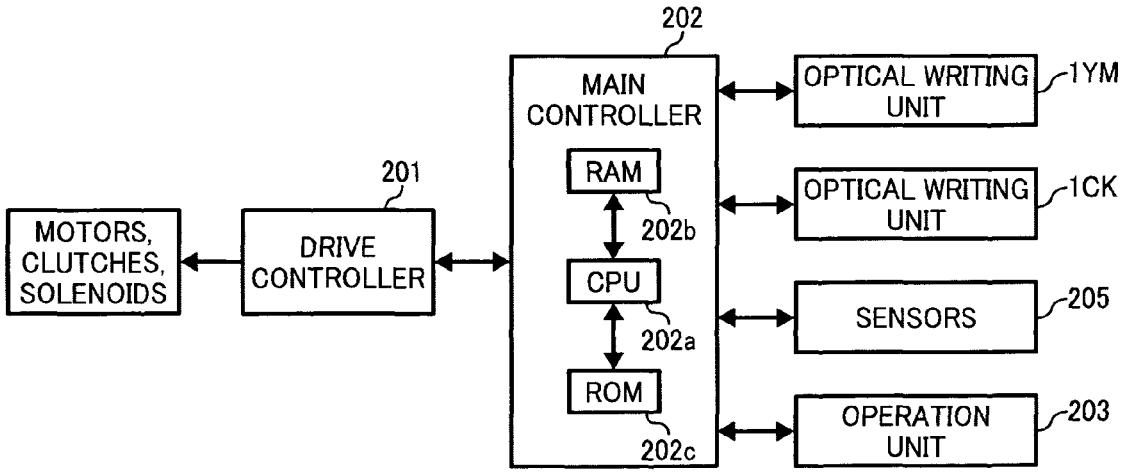
FIG. 14 is a schematic block diagram illustrating a selected portion of an electric circuit of the image forming apparatus of FIG. 1.

The fixing roller 41, which incorporates therein a heating element such as a halogen lamp and rotates in the counter-clockwise direction, is provided at the surface of the fixing belt 42 that contacts the elastic drive roller 43 to form a fixing nip with the surface of the fixing belt 42. The on or off of the heating element of the fixing roller 41 may be controlled by a fixing temperature controller section of the printer 100, which may be provided by a main controller 202 (FIG. 14). For example, the fixing temperature controller section may control the on or off of the heating element based on a detection result obtained by a temperature sensor that detects the surface temperature of the fixing belt 42 so as to keep the surface of the fixing belt 42 to be within a predetermined value. The temperature sensor may be provided near the surface of the fixing belt 42.

The recording sheet P that passes the secondary transfer nip is sent inside the fixing device 40 toward the fixing nip. At the fixing nip, the four-color toner image formed on the recording sheet P is heated and fixed.

The surface of the fixing belt 42 after passing the fixing nip is cleaned by the toner removal unit 45 that contacts the surface of the fixing unit 42. The toner removal unit 45, which includes a cleaning web, removes the residual toner from the surface of the fixing belt 42. The cleaning web of the toner removal unit 45, which has a belt-like shape, is wound around a plurality of rollers including a wind-up roller and a feed roller. The cleaning web, which stretches over the plurality of rollers, may be fed by the feed roller as the feed roller rotates and wound around by the wind-up roller as the wind-up roller rotates. As illustrated in FIG. 2, one pair of the plurality of rollers is provided between the feed roller and the wind-up roller so as to cause the cleaning web to contact the fixing belt 42 indirectly via the one pair of the plurality of rollers. When the accumulated residual toner wiped off from the surface of the fixing belt 42 reaches a predetermined amount, or when the accumulated time for wiping off the residual toner from the surface of the fixing belt 42 reaches a predetermined time, the cleaning web is wound by the wind-up roller by a predetermined amount. In this manner, the surface of the cleaning web that contacts the fixing belt 42 via the one pair of the plurality of rollers is kept clean.

The oil applying roller 46 is provided at a position close to the position where the fixing belt 42 contacts the heating roller 44. By rotating while contacting the surface of the fixing belt 42, the oil applying roller 46 applies oil, which functions as a releasing agent, to the surface of the fixing belt 42.

Near the oil applying roller 46, the oil receptor plate 49, the oil penetration felt 48, and the oil supplying roller 47 are provided. The oil receptor plate 49 stores therein the oil. The oil receptor plate 49 is provided with an overflow tube, which causes the oil stored in the oil receptor plate 49 to overflow when the oil reaches a predetermined position of the oil receptor plate 49. The oil receptor plate 49 is supplied with the oil from an oil supplying unit at predetermined timing. The excess amount of oil may be returned to the oil supplying unit through the overflow tube.

The oil receptor plate 49 includes the oil penetration felt 48, which is partially penetrated in the oil stored in the oil receptor plate 49. The impenetrated portion of oil penetration felt 48 is gradually penetrated with the oil by capillary action.

The oil supplying roller 47 rotates while contacting the oil penetration felt 48 and the oil applying roller 46 to apply the oil provided by the oil penetration felt 48 to the oil applying roller 46. In this manner, the surface of the oil applying roller 46, from which the oil is taken when the oil is applied to the surface of the fixing belt 42, is constantly replenished with the oil.

As described above referring to FIGS. 1 and 2, the fixing device 40 applies the oil to the fixing belt 42 so as to suppress the toner offset that may be caused in the fixing belt 42. Further, the oil applied to the fixing belt 42 is transferred to the fixing roller 41 at the portion of the fixing nip not having the recording sheet P so as to suppress the toner offset that may be caused in the fixing roller 41.

As described above referring to FIG. 1, the toner image is formed on one side of the recording sheet P at the secondary transfer nip, and fixed onto the recording sheet P by the fixing device 40. The recording sheet P having the fixed image thereon is transferred toward the transfer switch device 50.

The printer 100 includes a re-transfer mechanism or unit including the transfer switch device 50, a re-transfer path 54, a switch back path 55, and a switch back transfer path 56. More specifically, the transfer switch device 50 switches the direction of the recording sheet P that is transferred from the fixing device 40 to head toward selected one of the discharge path 51 and the re-transfer path 54. When performing a print job for the single printing mode to form an image on one side of the recording sheet P, the sheet discharge path 51 is selected. The recording sheet P having the image formed on one side thereon is transferred to the sheet discharge roller pair 52 through the sheet discharge path 51, and discharged outside of the printer 100 onto the sheet discharge tray 53. When performing a print job for the duplex printing mode to from images on both sides of the recording sheet P and when the recording sheet P having the images formed on the both sides thereof is transferred from the fixing device 40, the sheet discharge path 51 is selected. The recording sheet P having the images formed on the both sides thereof is transferred and discharged onto the sheet discharge tray 53. When performing a print job for the duplex printing mode and when the recording sheet P having an image formed on one side thereof is transferred from the fixing device 40, the re-transfer path 54 is selected.

The re-transfer path 54 meets the switch back path 55. The recording sheet P sent to the re-transfer path 54 enters the switch back path 55. The transfer direction of the recording sheet P entering the switch back path 55 is switched back. The switch back path 55 meets the switch back transfer path 56 in addition to the re-transfer path 54. The recording sheet P, which is switched back, enters the switch back transfer path 56. At this time, the side of the recording sheet P is reversed. The recoding sheet P is transferred through the switch back transfer path 56 and the sheet feed path 30 toward the secondary transfer nip. At the secondary transfer nip, the other side of the recording sheet P is formed with the toner image. The recording sheet P having the images formed on the both sides thereof is transferred to the fixing device 40 to be fixed. The recording sheet P is then transferred through the transfer switch device 50, the discharge path 51, and the discharge roller pair 52 to be discharged onto the sheet discharge tray 53.

Figure 3:
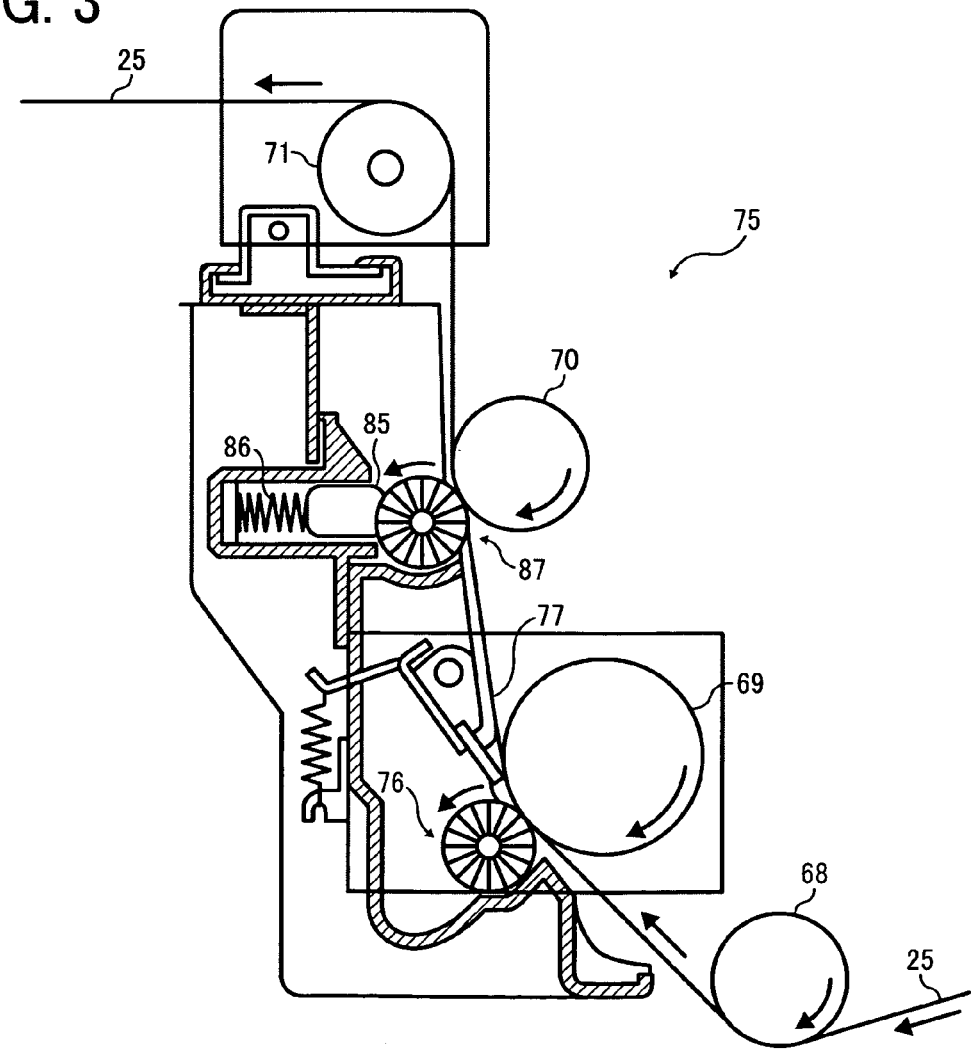
FIG. 3 is a schematic cross-sectional diagram illustrating an enlarged section of a belt cleaning unit provided in the image forming apparatus of FIG. 1 and its peripheral section including an intermediate transfer belt.

Referring to FIG. 3, a structure of the belt cleaning device 75 is explained. The belt cleaning device 75 includes a cleaning brush roller 76, a cleaning blade 77 functioning as a cleaning member, a lubricant applying brush roller 87, a lubricant solid 85, and a bias coil spring 86. The cleaning brush roller 76 and the cleaning blade 77 are provided near the position where the intermediate transfer belt 25 contacts a cleaning backup roller 69, which is provided inside the loop formed by the intermediate transfer belt 25. The lubricant applying brush roller 87 is provided near the position where the intermediate transfer belt 25 contacts an applying backup roller 70, which is provided inside the loop formed by the intermediate transfer belt 25.

The cleaning brush roller 76 includes a rotational shaft member and a brush roller that is provided along the circumferential surface direction of the rotational shaft member. The rotational shaft member may be made of metal. The brush roller may be made of a plurality of standing furs. The cleaning brush roller 76 is rotated by a drive device in the counterclockwise direction to cause the tip of the brush to be in contact with the intermediate transfer belt 25. As the brush contacts, the residual toner may be removed or scraped off from the surface of the intermediate transfer belt 25, or the residual toner may be uniformly spread throughout the surface of the intermediate transfer belt 25.

The cleaning blade 77 includes one end that is supported by a blade holder that is fixed, and another end that freely moves and is made in contact with the surface of the intermediate transfer belt 25 that has passed the cleaning brush roller 76. The cleaning blade 77 can thus remove the residual toner, which remains on the surface of the intermediate transfer belt 25 after being cleaned by the cleaning brush roller 76.

The surface of the intermediate transfer belt 25 after being cleaned by the cleaning brush roller 76 and the cleaning blade 77 is transferred to the position where the applying brush roller 87 is provided. The applying brush roller 87 includes a rotational shaft member and a brush roller that is provided along the circumferential surface direction of the rotational shaft member. The rotational shaft member may be made of metal. The brush roller may be made of a plurality of standing furs. The applying brush roller 87 is rotated by a drive device in the counterclockwise direction to cause the tip of the brush to be in contact with the intermediate transfer belt 25 and the lubricant solid 85. The lubricant solid 85 is pressed against the applying brush roller 87 by the bias coil spring 86. The applying brush roller 87 scrapes off a powder from the lubricant solid 85 as it rotates, and applies the powder onto the surface of the intermediate transfer belt 25. By applying the lubricant agent, transferability of the toner image from the intermediate transfer belt 25 to the recording sheet P improves. The lubricant solid 85 may be a zinc stearate solid.

Next, a blank section test performed by the inventors of the present application is explained. As illustrated in a table 1 of FIG. 8, the printer 100 of FIG. 1 is used to perform a blank section test. The inventors of the present application uses the printer 100 of FIG. 1 to observe the degree of a blank section that is appeared in the printed recording sheet that is discharged last after sequentially performing duplex printing for a predetermined number of recording sheets. The degree of blank section that is observed in the printed recording sheet is rated by a numerical value ranging from 5 to 1. The rate "5" indicates that there is no blank section that can be observed in the printed sheet. The rate "1" indicates that there is a blank section that can be clearly observed in the printed sheet. With the increased numerical value of the rate increases, the probability in observing a blank section in the printed recording sheet decreases. The table 1 of FIG. 8 illustrates the result of performing the blank section test. In this example, a non-coated paper of A3 size is used as the recording sheet P. The non-coated paper, which is transferred along with a longitudinal direction, is formed with images on both sides of the paper. Referring to the table 1 of FIG. 8, the numerical value in the parenthesis indicates the absolute humidity value. It is assumed that the blank section observed in the printed recording sheet is caused as described below. The recording sheet P absorbs the oil as it passes the fixing device 40 when an image is formed on a first side of the recording sheet P. When the recording sheet P having the image formed on the first side is re-transferred to the secondary transfer nip, the oil absorbed by the first side of the recording sheet P is applied to the intermediate transfer belt 25 either directly or indirectly via the secondary transfer roller 72.

As illustrated in the table 1, as the number of duplex printed sheets that has been sequentially printed increases, the rate is lowered indicating that there is most likely to observe the blank section. Further, assuming that the number of duplex printed sheets is kept the same, as the temperature and the humidity, which is an environmental factor, increase, the rate is lowered indicating that there is most likely to observe the blank section. Under the environment in which the temperature and the humidity are relatively low such as in the case of the temperature of 10 Celsius degree and the humidity of 15%, even when the duplex printing is sequentially performed for the large number of printed recording sheets such as 800 sheets, the rate is kept at 5 indicating that there is no blank section that is observed. Referring to the table 1 of FIG. 8, the environmental factor such as the temperature and the humidity has much influence on the occurrence probability of the blank section that may be caused by the undesired attachment of oil to the intermediate transfer belt 25.

The inventors of the present invention further performs a blank section test using the printer 100 of FIG. 1 to see whether the type of paper has any influence on the occurrence probability of the blank section as illustrated in FIG. 9. In this blank section test, a plurality of types of paper is used as the recording sheet P but under the same environment in which the temperature is 27 Celsius degree and the humidity is 80%. The result of the blank section test is illustrated in the table 2 of FIG. 9. In this example, the A3 size non-coated paper, the A3 matt coated paper, and the A3 gloss coated paper are respectively used.

As illustrated in the table 2, when the number of duplex printed sheets and the environmental factor are the same, the use of non-coated paper is most likely to cause the blank section to occur when compared with the case in which the mat coated paper and the gloss coated paper are used. This may be because the non-coated paper easily absorbs the oil from the fixing belt 42 when compared with the coated paper.

In order to suppress the occurrence of blank section, the inventors of the present invention causes the printer 100 to perform oil removal processing. As illustrated in FIG. 10, the inventors of the present invention performs a blank section test using the printer 100, while causing the printer 100 to perform oil removal processing by forming a toner image on an in-between printed sides area of the intermediate transfer belt 25. The printer 100 performs oil removal processing as follows. In the duplex printing mode, the printer 200 forms a toner image used for absorbing the oil, or absorbing the releasing agent, on the in-between printed sides area of the intermediate transfer belt 25. In one example, the in-between printed sides area of the intermediate transfer belt 25 is an area of the surface of the intermediate transfer belt 25 that is transferred in the moving direction and is provided between an area of the intermediate transfer belt 25 which is caused to be in contact with a first side of the recording sheet P and an area of the intermediate transfer belt 25 which is caused to be in contact with a second side of the recording sheet P. In another example, the in-between printed sides area of the intermediate transfer belt 25 is an area of the surface of the intermediate transfer belt 25 that is transferred in the moving direction and is provided between an area of the intermediate transfer belt 25 which is caused to be in contact with a second side of a preceding recording sheet P and an area of the intermediate transfer belt 25 which is caused to be in contact with a first side of a following recording sheet P that follows the preceding recording sheet P. The printer 100 is caused to form the toner image for absorbing the oil, i.e., the oil absorption toner image, on the in-between printed sides area of the intermediate transfer belt 25. When the in-between printed sides area of the intermediate transfer belt 25 enters the secondary transfer nip, at which the image is transferred by the secondary transfer roller 72, the printer 100 stops applying the secondary transfer bias power to the secondary transfer roller 72 to interrupt operation of transferring the toner image from the intermediate transfer belt 25 to the recording sheet P at the secondary transfer nip. As the transfer operation is interrupted, the oil absorption toner image is left on the in-between printed sides area of the intermediate transfer belt 25 even after the in-between printed sides area passes the secondary transfer nip. The in-between printed sides area of the intermediate transfer belt 25 having the oil absorption toner image thereon is transferred to enter the blade cleaning position at which the cleaning blade 77 and the intermediate transfer belt 25 are made in contact with each other (FIG. 3).

Figure 4:
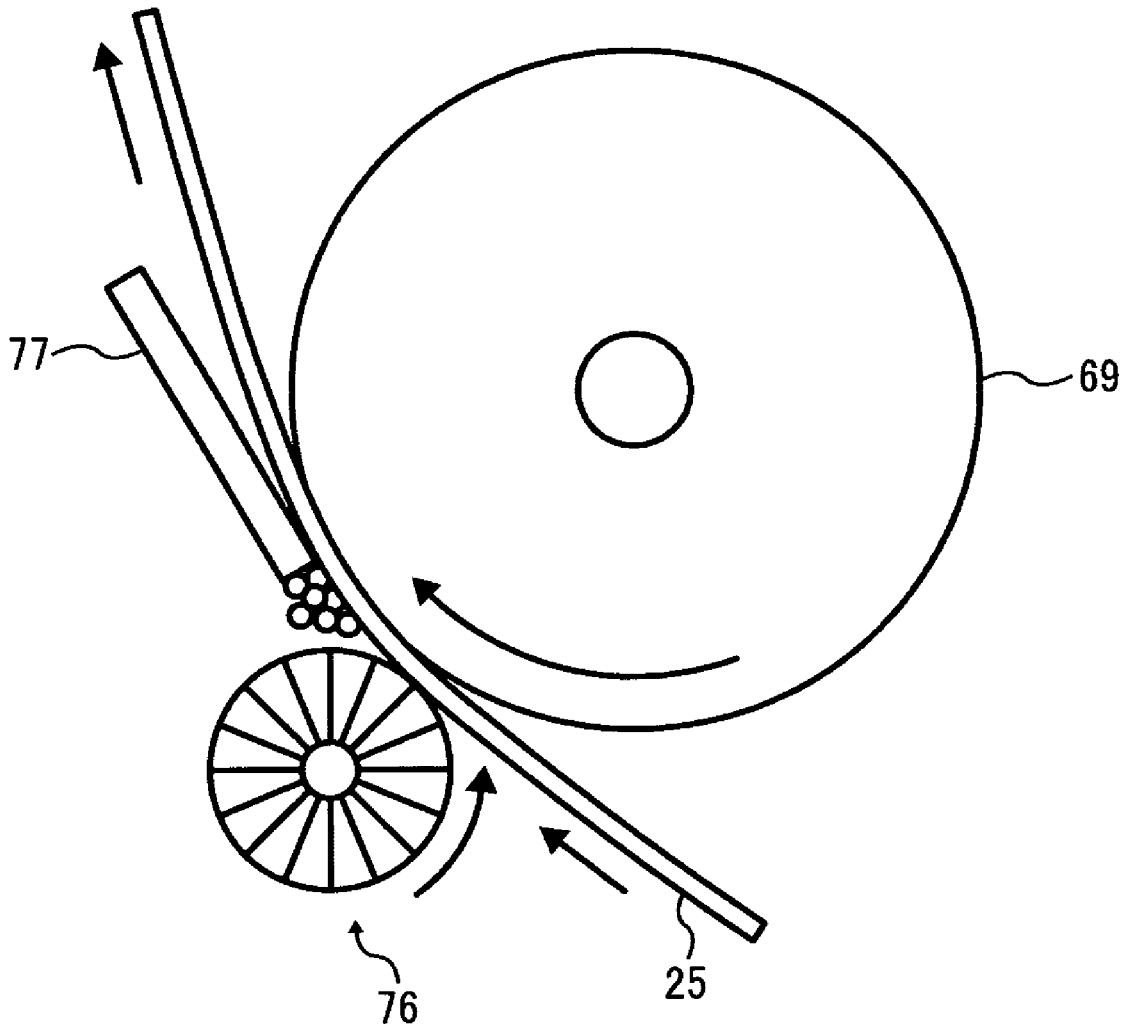
FIG. 4 is a schematic cross-sectional diagram illustrating an enlarged section of a blade cleaning position provided in the image forming apparatus of FIG. 1 and its peripheral section.

FIG. 4 illustrates an enlarged section of the blade cleaning position and its peripheral section of the printer 100. As described above referring to FIG. 3, the cleaning blade 77 includes the end that freely moves and is in contact with the surface of the intermediate transfer belt 25, which may be referred to as the free end. The edge of the free end of the cleaning blade 77 prevents the toner formed on the intermediate transfer belt 25 to be transferred further in the moving surface direction of the intermediate transfer belt 25. Thus, as illustrated in FIG. 4, the toner is kept in the area between the free end surface of the cleaning blade 77 that is provided upstream the free end edge in the moving surface direction, and the intermediate transfer belt 25. When the oil absorption toner image resides on the in-between printed sides area of the intermediate transfer belt 25 even after the in-between printed sides area passes the secondary transfer nip, the toner of the oil absorption toner image is blocked by the cleaning blade 77 at the blade cleaning position. The toner that is blocked at the position upstream the blade cleaning position in the belt moving surface direction while being kept in between the free end surface of the cleaning blade 77 and the intermediate transfer belt 25. The toner that is blocked is made in contact with the moving surface of the intermediate transfer belt 25 with friction. With the help of the friction force caused between the toner and the intermediate transfer belt 25, the toner absorbs the oil attached to the in-between printed sides area and the other area of the intermediate transfer belt 25. After a predetermined time period, the toner is scraped off from the intermediate transfer belt 25. In this manner, the oil is removed from the surface of the intermediate transfer belt 25. The above-described operation is performed while conducting the duplex printing to obtain the result of the blank section test. The above-described operation includes, for example, operation of forming the oil absorption toner image, operation of keeping the oil absorption toner image on the in-between printed sides area of the intermediate transfer belt 25 even after the in-between printed sides area passes the secondary transfer nip, operation of absorbing the oil by the friction force caused between the toner of the oil absorption toner image and the surface of the intermediate transfer belt 25 at the entry of the blade cleaning position, and operation of scraping off the toner that has absorbs the oil from the surface of the intermediate transfer belt 25.

Further, in this blank section test, the A3 non-coated paper is used as the recording sheet P under the environment of the temperature of 27 Celsius degree and the humidity of 80%. The result of the blank section test is illustrated in the table 3 of FIG. 10. Compared to the case in which the oil removal processing is not applied, the rate is efficiently lowered when the above-described oil removal processing is applied indicating that the occurrence of the blank section can be efficiently suppressed.

The above-described operation of oil removal processing is performed by a control system of FIG. 14. The control system of FIG. 14 includes a drive controller 201, which controls various drive devices provided in the printer 100. The examples of drive devices include, but not limited to various motors such as a photoconductor motor for driving the photoconductor, drive roller motor for driving one or more rollers, a registration roller motor for driving the registration roller pair, etc., a clutch, and a solenoid. The control system of FIG. 14 further includes a main controller 202, which controls operation of the various drive devices by sending a control signal to the drive controller 201, operation of controlling the optical writing units 1YM and 1CM, operation of performing computation based on the detection results of various sensors 205, and operation of interacting with the user through an operation unit 203. The main controller 202 includes a central processing unit (CPU) 202*a*, a random access memory (RAM) 202*b* for storing data at least temporarily, and a read only memory (ROM) 202*c* for storing data.

Figure 5:
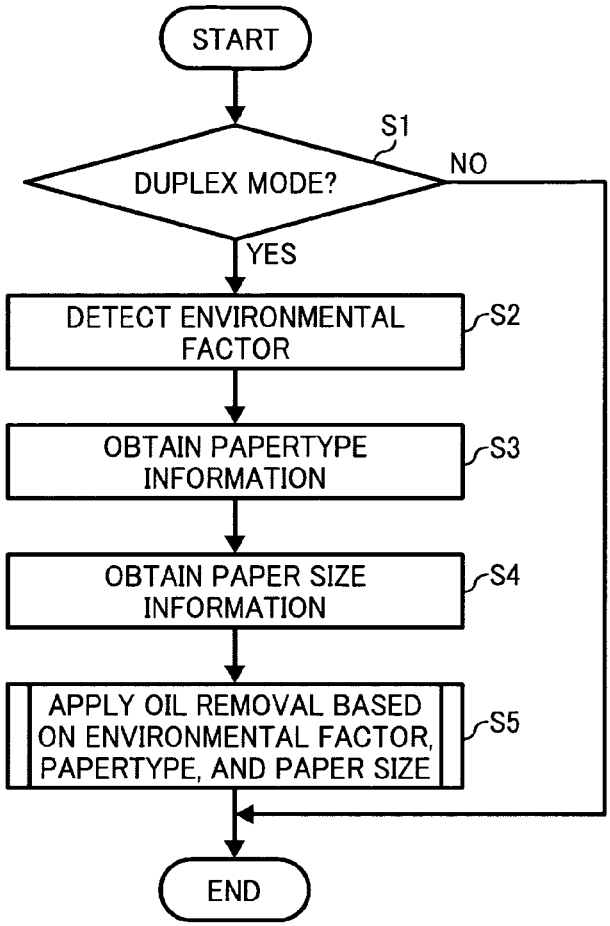
FIG. 5 is a flowchart illustrating operation of applying oil removal processing by forming an oil absorption toner image on an in-between printed sides area of the intermediate transfer belt, performed by the image forming apparatus of FIG. 1, according to an example embodiment of the present invention.

Referring now to FIG. 5, operation of applying oil removal processing, performed by the printer 100, is explained according to an example embodiment of the present invention. More specifically, in this example, the operation of FIG. 5 is performed by the main controller 202 of the printer 100 when the main controller 202 receives a user instruction for performing a printing job from the user through the operation unit 203.

At S1, the main controller 202 determines whether the user instruction selects a duplex printing mode. When it is determined that the duplex printing mode is selected ("YES" at S1), the operation proceeds to S2. When it is determined that the duplex printing mode is not selected ("NO" at S1), the operation ends to determine that no oil removal processing is necessary. In such case, the printing job is performed without performing the oil removal processing.

At S2, the main controller 202 detects an environmental factor. More specifically, in this example, the printer 100 is provided with a humidity sensor 205, which detects the humidity, such as the relative humidity, within the apparatus body as illustrated in FIG. 14. The printer 100 is further provided with a temperature sensor 205, which detects the temperature within the apparatus body. The main controller 202 receives the detection result from at least one of the humidity sensor 205 and the temperature sensor 205 at any desired time. The main controller 202 is provided with a memory such as the ROM 202*c*, which stores a absolute humidity data table to be used for determining the absolute humidity value. The absolute humidity data table is used to specify the absolute humidity value in g/m3 based on the humidity value expressed in % and the temperature value expressed in Celsius degree. More specifically, the main controller 202 uses the humidity value and the temperature value, which is respectively obtained from the humidity sensor 205 and the temperature sensor 205, as the key to obtain the absolute humidity value that corresponds to the obtained set of humidity value and temperature value.

At S3, the main controller 202 obtains paper type information. More specifically, in this example, the printer 100 is provided with a memory such as the ROM 202*c*, which stores paper type information regarding the type of paper that is stored in the first feed cassette 101 or the second feed cassette 102. The paper type information may be set by default or set by the user through the operation unit 203 such as a ten key. Examples of paper type include, but not limited to, non-coated paper, matt coated paper, and gloss coated paper. The main controller 202 obtains the paper type information regarding the recording sheet P that is stored in selected one of the first feed cassette 101 and the second feed cassette 102 from the memory. The selection of the feed cassette may be determined based on the user instruction for performing the printing job that is received from the user through the operation unit 203 or set by default.

At S4, the main controller 202 obtains paper size information regarding the recording sheet P based on the user instruction for performing the printing job. More specifically, in this example, the printer 100 is provided with a paper size detector 205, which detects the size of the recording sheet P that is to be fed by the first feed cassette 101 or the second feed cassette 102. For example, the paper size detector 205 detects the paper size based on the position of a pressure plate that presses the stack of the recording sheets P from the side, and outputs the detection result to the main controller 202. Based on the detection result, the main controller 202 obtains the paper size information regarding the recording sheet P to be used for performing the printing job.

After performing S2 of obtaining the absolute humidity, S3 of obtaining the paper type information, and S4 of obtaining the paper size information, at S5, the main controller 202 performs the duplex printing job while performing the oil removal processing. The oil removal processing is performed based on the environmental factor such as the absolute humidity, the paper type, and the paper size. The operation ends when the printing job is completed.

As described above, in this example, application of the secondary transfer bias power with respect to the secondary transfer roller 72 is interrupted when the in-between printed sides area of the intermediate transfer belt 25 enters the secondary transfer nip to interrupt the operation of transferring the oil absorption toner image at the secondary transfer nip. Alternatively, the operation of transferring the oil absorption toner image may be interrupted in various other ways. For example, a separating mechanism may be additionally provided, which prevents the secondary transfer roller 72 to be in contact with the intermediate transfer belt 25 when the in-between printed sides area of the intermediate transfer belt 25 enters the secondary transfer nip to interrupt the operation of transferring the oil absorption toner image at the secondary transfer nip.

In this example, the oil absorption toner image has a rectangular shape having a belt width length that extends in the width of the intermediate transfer belt 25 or in the main scanning direction. The belt width length of the oil absorption toner image may be set equal to a paper width size of the recording sheet P in the main scanning direction plus a predetermined value. In this example, the predetermined value is 5 mm, which is added to each one of the ends of the belt width size of the recording sheet P. More specifically, 10 mm of the predetermined value is added to the paper width size of the recording sheet P in the main scanning direction to obtain the belt width length of the oil absorption toner image. Further, in this example, the upper limit of the paper width size is set to be 330 mm, which is slightly smaller than the belt width of the intermediate transfer belt 25.

The belt-width length of the oil absorption toner image is determined based on the paper width size. Of the surface of the intermediate transfer belt 25 in the belt width direction, only the area that corresponds to the paper width of the recording sheet P receives the oil from the recording sheet P as the recording sheet P passes. For this reason, even when the oil absorption toner image is formed on the area not corresponding to the paper width of the recording sheet P, the toner formed on such area does not contribute to the oil removal processing. In order to save the toner, the belt-width length of the oil absorption toner image is determined based on the paper width size.

The oil absorption toner image further has a belt transfer direction length that extends in the transfer direction of the intermediate transfer belt 25 or in the sub-scanning direction. The belt transfer direction length, which may be referred to as the in-between printed sides direction length, is determined based on the detection result of the absolute humidity and the detection result of the paper size information. More specifically, in this example, the in-between printed sides direction length is set to 40 mm by default. This default value is multiplied by an environmental adjustment coefficient and further divided by a paper size adjustment coefficient to obtain the in-between printed sides direction length of the oil absorption toner image. The environmental adjustment coefficient is specified based on the absolute humidity expressed in g/m3 that is obtained at S2, and an environmental adjustment coefficient data table that is previously stored in the memory of the main controller 202. FIG. 11 illustrates a table 4, which corresponds to the environmental adjustment coefficient data table.

Referring to the table 4, when the absolute humidity is less than 15.0 g/m3, the environmental adjustment coefficient is specified as 0. As a result, the in-between printed sides direction length of 0 is obtained for the oil absorption toner image. When the absolute humidity is less than 15.0 g/m3, even in the case of duplex printing mode, the oil absorption toner image is not formed on the in-between printed sides area of the intermediate transfer belt 25. Thus, oil removal processing is not performed. When the absolute humidity is equal to or greater than 15.0 g/m3, the environmental adjustment coefficient is set to 1.0. As a result, the in-between printed sides direction length of greater than 0 is obtained for the oil absorption toner image. When the duplex printing is to be performed and when the absolute humidity is equal to or greater than 15.0 g/m3, oil removal processing is performed such that the oil absorption toner image is formed on the in-between printed sides area of the intermediate transfer belt 25. More specifically, when the user instruction for performing the duplex printing is received and when the environmental factor indicates that the absolute humidity is equal to or greater than 15.0 g/m3, oil removal processing is performed.

The environmental adjustment coefficient data table of the table 4 includes two values of 0 and 1 for the environmental adjustment coefficient. Alternatively, any desired number of environmental adjustment coefficient values may be used ranging from 0 to 1.0 such that the environmental adjustment coefficient value increases as the absolute humidity increases.

When the user instruction indicates to perform duplex printing for the monochrome image, the controller forms the oil absorption toner image using only the black color toner such that one black toner image is formed. When the user instruction indicates to perform duplex printing for the color image, the controller forms the oil absorption toner images using all four colors. In such case, the Y toner image, M toner image, C toner image, and K toner image are sequentially formed so as to be arranged in the in-between printed sides direction of the intermediate transfer belt 25. Further, the in-between printed sides direction size of each of the oil absorption toner images is the same for all colors and is set to be ¼ of the in-between printed sides direction size of the K oil absorption toner image. In order to make the consumption rate of the toner relatively uniform for all colors, the oil absorption toner images may be formed for all colors in the monochrome mode. However, in this example, when the monochrome mode is selected, the photoconductors 3Y, 3M, and 3C are separated away from the intermediate transfer belt 25 such that formation of the Y, M, and C toner images cannot be performed. Accordingly, only the K oil absorption toner image is formed in the monochrome mode.

Further, in this example, the paper type adjustment coefficient is set to 1.0 when the paper type is non-coated paper, and is set to 0.8 when the paper type is other than the non-coated paper. In this manner, when the non-coated paper is used that easily absorbs the oil, the in-between printed sides direction length of the oil absorption toner image is made larger when compared to the case of using other type of paper.

The paper size adjustment coefficient is specified based on the paper type information obtained at S3 of FIG. 5 and a paper size adjustment coefficient data table that is previously stored in the memory of the main controller 202. FIG. 12 illustrates a table 5, which is an example of the paper size adjustment coefficient data table.

The paper size detector 205, which may be provided in each of the first and second feed cassettes 101 and 102, may obtain information regarding the area of the recording sheet P. More specifically, as long as the transfer direction size and the belt width direction size of the recording sheet P is obtained, the area of the recording sheet P may be easily obtained. Based on the detection result of the paper size detector 205, which includes information regarding the transfer direction size and the belt width direction size of the recording sheet P, the main controller 202 specifies the paper size adjustment coefficient. As illustrated in the table 5, as the area of the recording sheet P increases, the paper size adjustment coefficient is made smaller. The paper size adjustment coefficient ranges from 1 to 4.13. The paper size adjustment coefficient divides the default value previously set for the in-between printed sides direction size of the oil absorption toner image. Accordingly, as the area of the recording sheet becomes larger, i.e., smaller the value for the paper size adjustment coefficient, the in-between printed sides direction size of the oil absorption toner image becomes larger.

At the secondary transfer nip, the amount of oil to be transferred from the recording sheet P to the intermediate transfer belt 25 increase proportionally to the area of the recording sheet P. Accordingly, with the increased area of the recording sheet P, the in-between printed sides direction size of the oil absorption toner image is made large such that the oil absorption toner image corresponds to the amount of oil to be transferred from the recording sheet P to the intermediate transfer belt 25. On the other hand, when the recording sheet P has a relatively small size such that its sub-scanning direction size is relatively small, the in-between printed sides area increases. In such case, the oil absorption toner image may be formed with the unnecessarily large size unless controlled. In this manner, the toner can be efficiently used to remove the oil from the intermediate transfer belt 25.

Further, the paper size adjustment coefficient of the table 5 is obtained using the equation: $[Ts*Ys*(Y+10)]/[T*Y*(Ys+10)]$. When the value of the equation is less than 1.0, or when the value of the equation is equal to or less than 1.0, the paper size adjustment coefficient is set to 1.0. In the above equation, Ts indicates 420 mm, which is the transfer direction size of the A3T size paper. Ys indicates 297 mm, which is the belt width direction size of the A3T size paper. In this example, Ts and Ys are determined based on the A3T size paper since the A3T size paper is used as the standard size paper. T indicates the transfer direction size, in mm, of the recording sheet P to be used for performing the current printing job. Y indicates the belt-width direction size, in mm, of the recording sheet P to be used for performing the current printing job. As described above, the transfer direction corresponds to the sub-scanning direction, while the belt-width direction corresponds to the main scanning direction.

Figure 6:
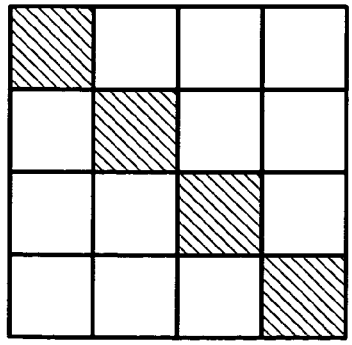
FIG. 6 is an illustration for explaining a dot matrix of a halftone image.

In this example, the main controller 202 forms a halftone image of dots as the oil absorption toner image. In order to make the halftone image, the dots are printed onto a dot area, which is a selected portion, of a dot matrix of a predetermined size to adjust the image tone. For example, as illustrated in FIG. 6, in the case of 4 by 4 dot matrix, four dot areas are selected to be formed with a dot. As the 4/16 matrix of FIG. 6 is formed on a specific area to which the toner image is formed, the solid halftone image is obtained. In this example, the number of dots to be formed on the specific image forming area, which is referred to as the dot area rate, is set to 10 to 50% for the halftone image to be used as the oil absorption toner image. When the dot area rate is adjusted to be 10 to 50%, the halftone image having the image density ID of 0.2 to 0.7 may be obtained in the case of printing the image on the recording sheet P of white color. In order to obtain the image density ID using the white color paper, the recording sheet P of type 6000_70W is used to form the toner image thereon, which is transferred from the intermediate transfer belt 25. The recording sheet P having the image formed thereon is placed on the top of a stack of 10 recording sheets P of type 6000_70W while facing the side having the image to be upward. The side having the image is measured by a spectrometer, such as the X-rite 939 spectrometer manufactured by the Nippon Lithograph, Inc. For example, the view angle is set to 2 degrees, while the illuminant D50 is used as the light source. Since the oil absorption toner image is formed as the halftone image, the load to the cleaning unit may be suppressed while suppressing the toner consumption.

Figure 7:
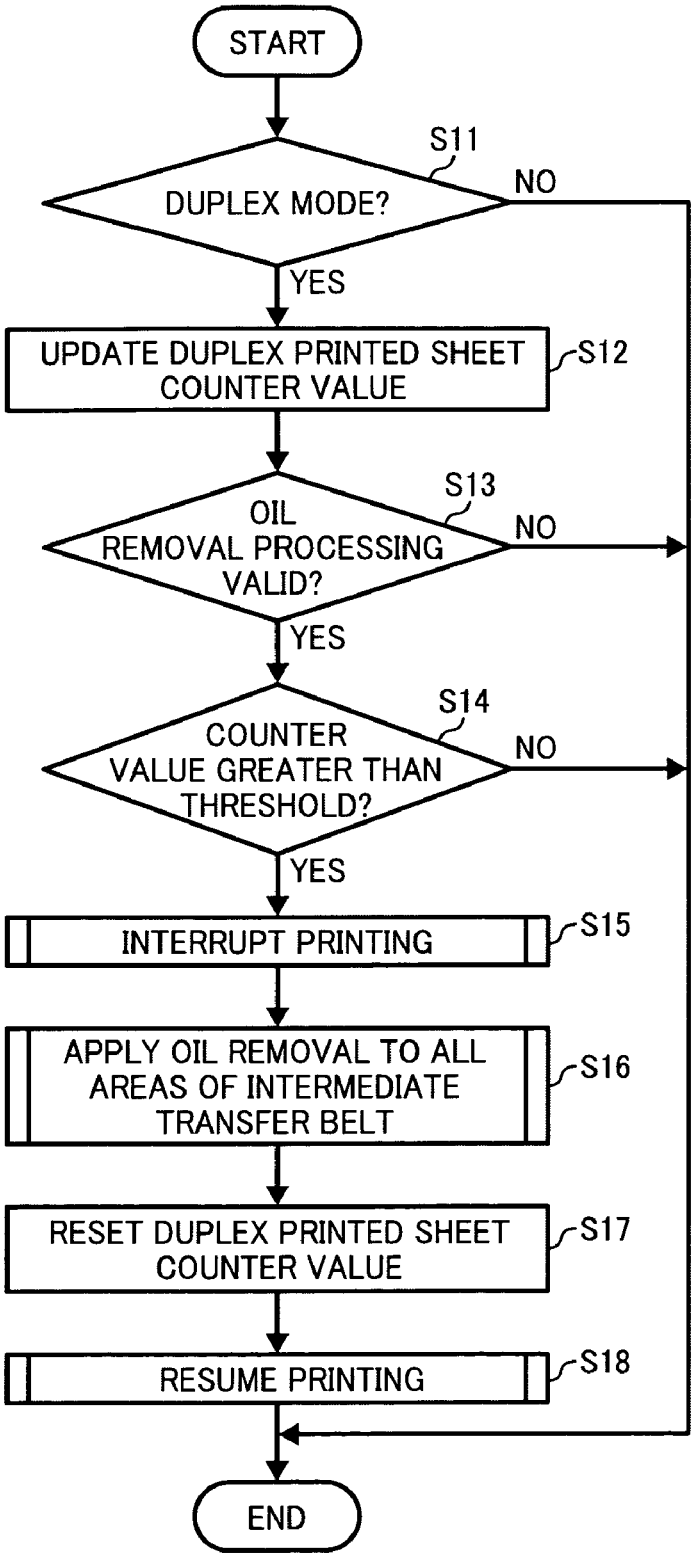
FIG. 7 is a flowchart illustrating operation of applying oil removal processing by forming an oil absorption toner image on all areas of the intermediate transfer belt, performed by the image forming apparatus of FIG. 1, according to an example embodiment of the present invention.

Referring now to FIG. 7, operation of performing oil removal processing by forming toner images throughout all areas of the intermediate transfer belt 25, performed by the main controller 202 of the printer 100 of FIG. 1, is explained according to an example embodiment of the present invention. The operation of FIG. 7 may be performed concurrently with the operation of FIG. 5.

At S11, when the main controller 202 receives the user instruction for performing a printing job through the operation unit 203, the main controller 202 determines whether the user instruction selects the duplex printing mode. When it is determined that the user instruction selects the duplex printing mode ("YES" at S11), the operation proceeds to S12. When it is determined that the user instruction does not select the duplex printing mode ("NO" at S1), the operation ends to determine that no oil removal processing of FIG. 7 is necessary. In such case, the printing job is performed without performing the oil removal processing of FIG. 7. However, as described above referring to FIG. 5, the oil removal processing of FIG. 5 may be performed while performing the printing job.

At S12, the main controller 202 updates a duplex printed sheet counter, which is provided in the printer 100 to detect the number of duplex printed sheets. More specifically, in this example, the paper size detector 205 capable of detecting the size of the recording sheet P is provided in each of the sheet feed cassettes 101 and 102, at the position where the pressure plate for pressing the stack of the recording sheets P from the side. The main controller 202 receives the detection result of the paper size detector 205, which indicates the size of the recording sheet P to be used for performing the duplex printing based on the user instruction. Based on the transfer direction size of the recording sheet P obtained from the paper size information, the main controller 202 updates the duplex printed sheet counter by one or two. The duplex printed sheet counter may be provided in the main controller 202, for example, in its register.

At S13, the main controller 202 determines whether applying of oil removal processing by forming the toner images to all areas of the intermediate transfer belt 25 is valid. In this example, the user may previously set applying of oil removal processing of FIG. 7 to be valid or not valid through the operation unit 203. When it is determined that the oil removal processing is not valid ("NO" at S13), the operation ends to perform the printing job based on the user instruction without performing the oil removal processing of FIG. 7. In such case, however, oil removal processing of FIG. 5 may be applied. When it is determined that the oil removal processing is valid ("YES" at S13), the operation proceeds to S14.

At S14, the main controller 202 compares the duplex printed sheet counter value obtained at S12 with a threshold value that is previously set for the oil removal processing to be applied by forming the toner images to all areas of the intermediate transfer belt 25 to generate a comparison result. Based on the comparison result, the main controller 202 determines whether to perform oil removal processing by forming the toner images to all areas of the intermediate transfer belt 25. When it is determined that the oil removal processing is to be performed ("YES" at S14), the operation proceeds to S15. When it is determined that the oil removal processing is not to be performed ("NO" at S14), the operation ends to perform the printing job based on the user instruction without performing the oil removal processing of FIG. 7. In such case, however, oil removable processing of FIG. 5 may be performed.

At S15, the main controller 202 interrupts printing operation so as to prepare for the oil removal processing to be applied by forming the toner images to all areas of the intermediate transfer belt 25. More specifically, image formation of a toner image to be formed on the surface of the intermediate transfer belt 25 is stopped for a recording sheet P that is not yet to be processed. When there is any toner image that has been already formed on the surface of the intermediate transfer belt 25, the main controller 202 waits until the toner image is transferred to the recording sheet P and output as the printed sheet. When the recording sheet P that has been processed is output, operation of transferring the recording sheet P that follows is stopped, for example, by sending a control signal to stop the registration roller motor through the drive controller 201.

At S16, the main controller 202 performs oil removal processing. More specifically, the main controller 202 forms the Y toner image, the M toner image, the C toner image, and the K toner image, which are sequentially arranged in the belt transfer direction, on all areas of the intermediate transfer belt 25. The main controller 202 further stops applying the secondary transfer bias power with respect to the secondary transfer roller 72 to stop operation of transferring the toner image at the secondary transfer nip. As the intermediate transfer belt 25 is transferred, the toner images formed thereon enter the blade cleaning position. The toner of the toner images is kept by the free end surface of the cleaning blade 77 until it is scraped off.

At S17, the main controller 202 initializes the duplex printed sheet counter value to be 0.

At S18, the main controller 202 resumes operation of performing the duplex printing to perform formation of the toner image and transfer of the recording sheet P, and the operation ends.

As described above, when performing the duplex printing sequentially for a plurality of recording sheets P, the printer 100 is capable of applying oil removal processing without causing the printer 100 to be turned off so as to suppress the occurrence of the blank section. More specifically, as described above referring to FIG. 7, when the duplex printed sheet counter value reaches the predetermined value, the printer 100 may be caused to perform operation of FIG. 7 in addition to operation of FIG. 5 such that the toner can be sufficiently removed from the surface of the intermediate transfer belt 25 but without interrupting the printing job being performed. The above-described operation includes, for example, operation of forming the oil absorption toner image throughout all areas of the intermediate transfer belt 25, operation of keeping the oil absorption toner image on the intermediate transfer belt 25 even after the oil absorption toner image passes the secondary transfer nip, operation of absorbing the oil by the friction force caused between the toner of the oil absorption toner image and the surface of the intermediate transfer belt 25 at the entry of the blade cleaning position, and operation of scraping off the toner that has absorbed the oil from the surface of the intermediate transfer belt 25.

In alternative to the oil removal processing that is performed automatically by the main controller 202 when performing the printing job, the main controller 202 may perform oil removal processing at any desired time, for example, according to a user instruction even when the printing job is not performed. Since the surface of the intermediate transfer belt 25 may be degraded over time, the above-described oil removal processing may not sufficiently remove the oil from the surface of the intermediate transfer belt 25. When the user observes a blank section in the printed recording sheet, the user may instruct the printer 100 to perform oil removal processing through the operation unit 203. When the user instruction for requesting oil removal processing is received, the main controller 202 forms an oil absorption toner image on all areas of the surface of the intermediate transfer belt 25 as described above referring to FIG. 7. Further, the main controller 202 stops applying the secondary transfer bias power with respect to the secondary transfer roller 72 to stop the operation of transferring the toner image at the secondary transfer nip. As the intermediate transfer belt 25 moves, the oil absorption toner images that are extended throughout the surface of the intermediate transfer belt 25 enter the blade cleaning position. In this example, the oil absorption toner image may be formed as the Y toner image, the M toner image, the C toner image, and the K toner image, which are sequentially arranged in the belt transfer direction, with each toner image having the same belt transfer direction length. Accordingly, the amount of toner consumption is made equal for all colors.

Further, in the above-example case of performing the oil removal processing according to the user instruction, the intermediate transfer belt 25 is rotated about 5 times from the time at which the oil absorption toner images are formed until the time at which the oil removal processing ends. In order to cause all the oil absorption toner images that are formed throughout the surface of the intermediate transfer belt 25 to enter the blade cleaning position, the intermediate transfer belt 25 needs to be rotated at least 1.5 times. However, in order to sufficiently remove the oil from the surface of the intermediate transfer belt 25, the intermediate transfer belt 25 is rotated more than 1.5 times.

Further, the main controller 202 may change the number of forming the oil absorption toner image onto a plurality of in-between printed sides areas of the intermediate transfer belt 25 according to the amount of total use of the cleaning blade 77. In this example, the amount of total use of the cleaning blade 77 may be counted using the paper size of the recording sheet P. More specifically, when the paper size of the recording sheet P is relatively small such that the A4 paper size or the LT paper size is used, the use of the cleaning blade 77 is counted as one. When the paper size of the recording sheet P is relatively large such that the A3 paper size or the DLT paper size is used, the use of the cleaning blade 77 is counted as two. When a new cleaning blade 77 is installed, the amount of the total use of the cleaning blade 77 is reset. Alternatively, the amount of the total use of the cleaning blade 77 may be obtained using the transfer distance of the intermediate transfer belt 25, the transfer time of the intermediate transfer belt 25, or any other parameter.

When the amount of the total use of the cleaning blade 77 is relatively small, the main controller 202 may cause the number of forming the oil absorption toner images on the plurality of in-between printed sides areas to be low. When the amount of the total use of the cleaning blade 77 is relatively large, the main controller 202 may cause the number of forming the oil absorption toner image on the plurality of in-between printed sides areas to be large. For the descriptive purpose, the number of forming the oil absorption toner image may be referred to as the toner image frequency rate.

The inventors of the present application performs a blank section test as illustrated in a table 6 of FIG. 13. In this blank section test, the duplex printing is performed on the A3 size non-coated paper under the environment of the temperature of 23 Celsius degree and the humidity of 50%. Further, in this example, the image that is formed on the recording sheet has an image area rate of 5%. The toner image frequency rate of the oil absorption toner image is changed among three values. For each toner image frequency rate, 400,000 sheets of the A3 size non-coated paper are sequentially printed. In this example, the odd page is output onto the first side of the recording sheet, while the even page is output onto the second side of the recording sheet.

Referring to the table 6 of FIG. 13, under the condition 1, the image forming frequency rate of the oil absorption toner image is changed according to the total use of the cleaning blade 77, while the image forming frequency rate is not changed under the conditions 2 and 3. More specifically, under the condition 1, when the number of recording sheets that have been output falls in the range of 0 to 200,000 pages, the oil absorption toner image is formed on the in-between printed sides area of the intermediate transfer belt 25 every time when one page of the recording sheet is output out of four pages of the recording sheets are output. When the number of printed recording sheets that have been output falls in the range 200,001 to 300,000 pages, the oil absorption toner image is formed on the in-between printed sides area of the intermediate transfer belt 25 every time when one page of the recording sheet is output out of two pages of the recording sheets are output. When the number of printed recording sheets that have been output falls in the range 300,001 to 400,000 pages, the oil absorption toner image is formed on the in-between printed sides area of the intermediate transfer belt 25 every time when one page of the recording sheet is output. Under the condition 2, when the number of printed recording sheets that have been output falls in the range 0 to 400,000 pages, the oil absorption toner image is formed on the in-between printed sides area of the intermediate transfer belt 25 every time when one page of the recording sheet is output out of four pages of the recording sheets are output. Under the condition 3, when the number of printed recording sheets that have been output falls in the range 0 to 400,000 pages, the oil absorption toner image is formed on the in-between printed sides area of the intermediate transfer belt 25 every time when one page of the recording sheet is output.

For every conditions 1, 2, and 3, the halftone image of black color is formed on one side of the A3 non-coated paper to observe whether there is a blank section every time the number of printed recording sheets reaches 50,000 pages, 150,000 pages, 250,000 pages, and 350,000 pages. By visually checking the halftone image, the rate ranging from 5 to 1 is assigned to indicate whether a blank section can be easily observed. Referring to FIG. 6, the toner consumption value is evaluated based on the number of toner consumption detected for the condition 1, which is assigned with the value 1.

As in the case of condition 2, when the image forming frequency rate is set to be relatively low despite the number of accumulated printed recording sheets, the rate is lowered as the total use of the cleaning blade 77 increases while keeping the toner consumption low. As in the case of condition 3, when the image forming frequency rate is set to be relatively large despite the number of accumulated printed recording sheets, the rate is kept relatively high but the toner consumption is kept high as well. When the image forming frequency rate is changed according to the total use of the cleaning blade 77, or the total number of printed recording sheets, as in the case of the condition 1, the rank is kept relatively high while suppressing the toner consumption. In this example, the image forming frequency rate is preferably changed according to the paper size of the recording sheet for use. For example, when the paper size of the recording sheet is relatively small such that the A4 paper size or the LT paper size is used, the image forming frequency rate may be made lower such as by half of the image forming frequency rate of the example case of using the A3 size paper.

The printer 100 of FIG. 1 may perform oil removal processing in various other ways, for example, as described below, while keeping the mechanical structure of the printer 100 substantially the same as that of the printer 100 illustrated in FIG. 1. In this example, instead of changing the in-between printed sides direction length of the oil absorption toner image according to the paper size or area of the recording sheet P, the image forming frequency rate of the toner image to be formed on a plurality of in-between printed sides areas of the intermediate transfer belt 25 is changed. More specifically, in order to make the amount of oil to be removed relatively larger, the main controller 202 forms the oil absorption toner image onto all of the plurality of in-between printed sides areas of the intermediate transfer belt 25 when performing the duplex printing. In order to make the amount of oil to be removed relatively smaller, the main controller 202 forms the oil absorption toner image onto a portion of the plurality of in-between printed sides areas of the intermediate transfer belt 25 when performing the duplex printing.

As described above, a controller such as the main controller 202 controls the following operation of the printer 100 when a user instruction for performing a duplex printing is received. The controller forms a releasing agent absorption toner image to be used for absorbing a releasing agent such as oil, onto an in-between printed sides area of an image carrier such as the intermediate transfer belt 25. When the releasing agent absorption toner image enters a transfer position as the image carrier moves, the controller interrupts operation of transferring an image so as to keep the releasing agent absorption toner image on the in-between printed sides area of the image carrier even after passing the transfer position. The releasing agent absorption toner image left on the in-between printed sides area of the image carrier enters a cleaning position at which a cleaning member and the image carrier are in contact with each other. At the cleaning position, the cleaning member blocks toner of the releasing agent absorption toner image from being further transferred. The toner that is blocked is kept at an area between the cleaning member and the image carrier, which is provided upstream the cleaning position in the surface transfer direction of the image carrier. The toner that is blocked is further pressed against the surface of the image carrier that is moving with friction force generated between the toner and the surface of the image carrier. With the friction force, the toner absorbs the releasing agent that is attached to the in-between printed sides area of the image carrier as well as the toner attached to the other area. The toner that is blocked is further scraped off from the surface of the image carrier. In this manner, the releasing agent is removed from the surface of the image carrier. As described above, while performing the duplex printing, the controller performs operation of forming the releasing agent absorption toner image, keeping the releasing agent absorption toner image on the in-between printed sides area of the image carrier even after the in-between printed sides area passes the transfer position, causing the toner of the releasing agent absorption toner image to be in contact with the surface of the image carrier at the entry of the cleaning position to make the releasing agent attached to the image carrier to be absorbed by the toner with the friction force, and scraping off the toner from the image carrier. With the above-described operation, the occurrence of a blank section is suppressed.

Further, in another example, only when the user instruction for performing the duplex printing is received and when the absolute humidity, which is obtained as the detection result of an environmental factor detector, is equal to or greater than 15.0 g/m3, the controller performs oil removal processing. In this manner, when the absolute humidity is relatively low such that the occurrence rate of the blank section is relatively low, the releasing agent absorption toner image is not formed. Accordingly, the toner consumption can be efficiently suppressed. Alternatively, the detection result of the environmental factor detector may include a relative humidity or a temperature. Alternatively, only when the controller receives the detection result of a paper type information obtainer indicating that the paper type of a recording sheet for use is non-coated paper, the controller performs oil removal processing. When the recording sheet P is the coated paper, which is not most likely to cause a blank section, the oil removal processing is not performed. Thus, the toner consumption can be efficiently suppressed.

In another example, the releasing agent absorption toner image may be formed in various ways, depending on the detection result of information regarding the recording sheet. For example, the releasing agent absorption toner image may be formed differently depending on the paper type or the paper size of the recording sheet P. Alternatively, the releasing agent absorption toner image may be formed differently depending on the absolute humidity value.

For example, the size, such as the transfer direction length, of the releasing agent absorption toner image may be changed according to the paper size information or the humidity information.

In another example, when the duplex printing is sequentially performed for a plurality of recording sheets, the releasing agent absorption toner image may be formed on a plurality of in-between printed sides areas of the image carrier that occur as the plurality of recording sheets P is sequentially transferred. Further, the image forming frequency rate indicating the number of the releasing agent absorption toner image that is formed may be changed depending on the detection result of the paper type information or the environmental factor such as the absolute humidity.

In another example, when the duplex printing is sequentially performed for a plurality of recording sheets, the image forming frequency rate indicating the number of the releasing agent absorption toner image that is formed on a plurality of in-between printed sides areas of the image carrier may be changed depending on information indicating the amount of the total use of the cleaning member such as the cleaning blade. The information indicating the amount of the total use of the cleaning member may be obtained by a counter. Accordingly, the releasing agent absorption toner image is formed according to the total use of the cleaning member. This suppresses the toner consumption while suppressing the occurrence of the blank section.

In another example, the main controller 202 may be provided, which counts the total use of the cleaning blade 77. The toner image forming rate for forming the oil absorption toner image may be determined based on the counter value of the total use of the cleaning blade 77. When sequentially performing the duplex printing for a plurality of recording sheets, the toner image forming rate is changed with respect to a plurality of in-between printed sides areas of the intermediate transfer belt 25 for more than one of the recording sheets. As the toner image forming rate is changed according to the total use of the cleaning blade 77, the occurrence of blank section is suppressed while keeping toner consumption low.

In another example, the width of the releasing agent absorption toner image may be changed depending on the width of the recording sheet P, which may be obtained by a paper size detector. This suppresses the toner consumption while suppressing the occurrence of the blank section.

In another example, the transfer direction size of the releasing agent absorption toner image may be changed depending on the area of the recording sheet P, which may be obtained by the paper size detector. This allows the amount of toner of the releasing agent absorption toner image to be adjusted according to the amount of oil that is transferred to a fixing belt or a fixing roller from the recording sheet P.

In another example, when the duplex printing is sequentially performed for a plurality of recording sheets, the image forming frequency rate indicating the number of the releasing agent absorption toner image that is formed on a plurality of in-between printed sides areas of the image carrier may be changed depending on information indicating the area of the recording sheet P, which may be obtained by the paper size detector. This allows the amount of toner of the releasing agent absorption toner image to be adjusted according to the amount of oil that is transferred to a fixing belt or a fixing roller from the recording sheet P.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

In one example, the above-described operation may be performed in various other ways, for example, as an image forming system. The image forming system may include an image forming apparatus and a computer such as a personal computer connected to the image forming apparatus through a network such as a local area network. Through the computer, the user may instruct the image forming apparatus to perform various operations including operation of performing the duplex printing or operation of applying oil removal processing. Further, any portion of the instructions which cause a computer to apply oil removal processing may be installed onto a computer, which is capable of controlling the image forming apparatus.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, involatile memory cards, ROM (read-only-memory), etc. For example, any portion of the computer program that causes any desired processor to perform the above-described operation of performing oil removable processing may be stored in any desired storage medium. For example, when such program is stored in the memory of the control system of FIG. 14 such as the ROM 202*c*, the main controller 202 of the printer 100 controls various devices to perform the above-described operation of applying oil removal processing. Any portion of the above-described computer program may be distributed, for example, in the form of firmware through a network to cause an image forming apparatus to function as the printer 100 of FIG. 1. Further, any portion of the above-described computer program may be downloaded or uploaded through the network.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

In another example, the present invention may reside in an image forming apparatus, comprising: image forming means for forming a toner image on a moving surface of an image carrier at an image forming position; transferring means for transferring the toner image formed on the moving surface of the image carrier to a recording medium at a transfer position while causing the recording medium to be in contact with the moving surface of the image carrier; fixing means for fixing the toner image on the recording medium while causing a fixing member to be in contact with the recording medium that is transferred from the transferring means; applying means for applying a toner releasing agent to a surface of the fixing member; means for re-transferring the recording medium transferred from the fixing means and having the toner image fixed on a first side thereof to the transferring means after reversing the first side of the recording medium so as to cause a second side of the recording medium to have an image formed and fixed thereon; means for cleaning a portion of the moving surface of the image carrier which has passed the transfer position at which the toner image is transferred by the transferring means but before enters the image forming position at which the toner image is formed by the image forming means by causing a cleaning member to be in contact with the portion of the moving surface of the image carrier at a cleaning position to remove toner from the portion of the moving surface; an environmental factor sensor configured to detect at least one of a temperature and a humidity to output a detection result; and means for controlling. The means for controlling is to switch between a single printing mode to form the toner image on the first side of the recording medium, and a duplex printing mode to cause the re-transferring means to re-transfer the recording medium and form the toner images on both of the first and second sides of the recording medium, according to an instruction received from an operator. The means for controlling is to cause the image forming means to form a releasing agent absorption toner image for absorbing the releasing agent on an in-between printed sides area of the moving surface of the image carrier based on the detection result of the environmental factor sensor when the instruction received from the operator selects the duplex printing mode. The in-between printed sides area of the moving surface of the image carrier being at least one of: a portion of the moving surface of the image carrier provided between a portion of the surface of the moving image carrier that is made in contact with the first side of the recording medium and a portion of the moving surface of the image carrier that is made in contact with the second side of the recording medium; and a portion of the moving surface of the image carrier provided between a portion of the moving surface of the image carrier that is made in contact with the second side of the recording medium and a portion of the moving surface of the image carrier that is made in contact with a first side of a following recording medium being transferred subsequently after the recording medium. When the in-between printed sides area of the moving surface of the image carrier being transferred enters the transfer position, the means for controlling interrupts the transferring operation of transferring the toner image from the image carrier to the recording medium performed by the transferring means to keep the releasing agent absorption toner image on the in-between printed sides area of the moving surface of the image carrier even after the in-between printed sides area of the moving surface passes the transfer position.

In the above-described example, the cleaning member is configured to collect toner resided on the image carrier at the cleaning position at which the cleaning member is made in contact with the image carrier by blocking the toner from being transferred with the moving surface of the image carrier, and to hold the collected toner between a portion of the cleaning member upstream the cleaning position in the transfer direction of the moving surface of the image carrier and the moving surface of the image carrier.

In the above-described example, the image forming apparatus further includes a recording medium type information obtain device to obtain recording medium type information indicating the type of the recording medium to be transferred to the transfer position. Only when at least one of the detection result of the environmental factor sensor and the recording medium type information satisfies a predetermined condition, the means for controlling is to cause the image forming means to form the releasing agent absorption toner image and to interrupt the transferring operation performed by the transferring means.

In the above-described example, based on the duplex printed amount, the means for controlling further stops the operation of transferring the recording medium, causes the image forming means to form a releasing agent absorption toner image throughout all areas of the moving surface of the image carrier in the moving direction, and keeps the releasing agent absorption toner image on the all areas of the moving surface of the image carrier.

In the above-described example, an image forming condition of forming the releasing agent absorption toner image is changed based on at least one of the detection result of the environmental factor sensor and the recording medium type information.

In the above-described example, the image forming condition of forming the releasing agent absorption toner image is a size of the releasing agent absorption toner image in the direction of transferring the recording medium through the image carrier.

In the above-described example, the image forming condition of forming the releasing agent absorption toner image is a toner image forming frequency indicating how frequency the releasing agent absorption toner image is formed with respect to a plurality of in-between printed sides areas of the image carrier when the duplex printing is sequentially performed for a plurality of recording mediums.

In the above-described example, the image forming apparatus further includes: means for obtaining an accumulated use of the cleaning member. When the duplex printing is sequentially performed for a plurality of recording mediums, the toner image forming frequency is made relatively low when the accumulated use of the cleaning member is relatively low and the toner image forming frequency is made relatively high when the accumulated use of the cleaning member is relatively high.

In the above-described example, the image forming apparatus further includes: a recording medium size information obtaining device configured to obtain recording medium size information indicating a size of the recording medium in the direction perpendicular to the direction of which the recording medium is transferred to the transfer position. The means for controlling further changes a size of the releasing agent absorption toner image in the direction perpendicular to the direction of which the recording medium is transferred based on the recording medium size information.

In the above-described example, the recording medium size information obtaining device is an area information obtaining device to obtain recording medium area information indicating the area of the recording medium. The means for controlling further changes a size of the releasing agent absorption toner image in the direction of which the recording medium is transferred based on the recording medium area information.

In the above-described example, the recording medium size information obtaining device is an area information obtaining device to obtain recording medium area information indicating the area of the recording medium. When the duplex printing is sequentially performed for a plurality of recording mediums, the means for controlling changes the toner image forming frequency based on the recording medium area information.

In the above-described example, the releasing agent absorption toner image is a halftone toner image.

In the above-described example, the cleaning member is a cleaning blade having one end supported by means for supporting and another end configured to freely move so as to be made in contact with the image carrier.

In another example, the present invention may reside in an image forming apparatus, comprising: image forming means for forming a toner image on a moving surface of an image carrier at an image forming position; transferring means for transferring the toner image formed on the moving surface of the image carrier to a recording medium at a transfer position while causing the recording medium to be in contact with the moving surface of the image carrier; fixing means for fixing the toner image on the recording medium while causing a fixing member to be in contact with the recording medium that is transferred from the transferring means; applying means for applying a toner releasing agent to a surface of the fixing member; means for re-transferring the recording medium transferred from the fixing means and having the toner image fixed on a first side thereof to the transferring means after reversing the first side of the recording medium so as to cause a second side of the recording medium to have an image formed and fixed thereon; means for cleaning a portion of the moving surface of the image carrier which has passed the transfer position at which the toner image is transferred by the transferring means but before enters the image forming position at which the toner image is formed by the image forming means by causing a cleaning member to be in contact with the portion of the moving surface of the image carrier at a cleaning position to remove toner from the portion of the moving surface; and means for controlling. The means for controlling is to switch between a single printing mode to form the toner image on the first side of the recording medium, and a duplex printing mode to cause the re-transferring means to re-transfer the recording medium and form the toner images on both of the first and second sides of the recording medium, according to an instruction received from an operator. The means for controlling is to cause the image forming means to form a releasing agent absorption toner image for absorbing the releasing agent on an in-between printed sides area of the moving surface of the image carrier when the instruction received from the operator selects the duplex printing mode. The in-between printed sides area of the moving surface of the image carrier being at least one of: a portion of the moving surface of the image carrier provided between a portion of the surface of the moving image carrier that is made in contact with the first side of the recording medium and a portion of the moving surface of the image carrier that is made in contact with the second side of the recording medium; and a portion of the moving surface of the image carrier provided between a portion of the moving surface of the image carrier that is made in contact with the second side of the recording medium and a portion of the moving surface of the image carrier that is made in contact with a first side of a following recording medium being transferred subsequently after the recording medium. When the in-between printed sides area of the moving surface of the image carrier being transferred enters the transfer position, the means for controlling interrupts the transferring operation of transferring the toner image from the image carrier to the recording medium performed by the transferring means to keep the releasing agent absorption toner image on the in-between printed sides area of the moving surface of the image carrier even after the in-between printed sides area of the moving surface passes the transfer position.

The invention claimed is:

1. An image forming apparatus, comprising:

an image forming unit configured to form a toner image on a moving surface of an image carrier at an image forming position;

a transfer unit configured to transfer the toner image formed on the moving surface of the image carrier to a recording medium at a transfer position while causing the recording medium to be in contact with the moving surface of the image carrier;

a fixing unit including a fixing member and configured to fix the toner image on the recording medium while causing the fixing member to be in contact with the recording medium that is transferred from the transfer unit;

a re-transfer unit configured to re-transfer the recording medium transferred from the fixing unit and having the toner image fixed on a first side thereof to the transfer unit after reversing the first side of the recording medium so as to cause a second side of the recording medium to have an image formed and fixed thereon;

a cleaning unit including a cleaning member and configured to clean a portion of the moving surface of the image carrier which has passed the transfer position at which the toner image is transferred by the transfer unit but before entering the image forming position at which the toner image is formed by the image forming unit by causing the cleaning member to be in contact with the portion of the moving surface of the image carrier to remove toner from the portion of the moving surface; and a controller configured to:

switch between a single printing mode to form the toner image on the first side of the recording medium, and a duplex printing mode to cause the re-transferring unit to re-transfer the recording medium and form the toner images on both of the first and second sides of the recording medium, according to an instruction received from an operator, cause the image forming unit to form a releasing agent absorption toner image for absorbing the releasing agent on an in-between printed sides area of the moving surface of the image carrier when the instruction received from the operator selects the duplex printing mode, wherein the in-between printed sides area of the moving surface of the image carrier is at least one of:

a portion of the moving surface of the image carrier provided between a portion of the surface of the moving image carrier that is made in contact with the first side of the recording medium and a portion of the moving surface of the image carrier that is made in contact with the second side of the recording medium; and a portion of the moving surface of the image carrier provided between a portion of the moving surface of the image carrier that is made in contact with the second side of the recording medium and a portion of the moving surface of the image carrier that is made in contact with a first side of a following recording medium subsequently transferred after the recording medium, and when the in-between printed sides area of the moving surface of the image carrier enters the transfer position, the controller interrupts the transferring operation of transferring the releasing agent absorption toner image from the image carrier to the recording medium performed by the transfer unit to keep the releasing agent absorption toner image on the in-between printed sides area of the moving surface of the image carrier even after the in-between printed sides area of the moving surface passes the transfer position.

2. The image forming apparatus of claim 1, wherein the cleaning member is configured to collect toner resided on the image carrier at the cleaning position at which the cleaning member is made in contact with the image carrier by blocking the toner from being transferred downstream with the moving surface of the image carrier, and to hold the collected toner between a portion of the cleaning member upstream the cleaning position in the transfer direction of the moving surface of the image carrier and the moving surface of the image carrier to cause the collected toner to absorb a releasing agent resided on the moving surface of the image carrier.

3. The image forming apparatus of claim 1, further comprising:

an environmental factor sensor configured to detect at least one of a temperature and a humidity to output a detection result, wherein the controller is configured to cause the image forming unit to form the releasing agent absorption toner image and to interrupt the transferring operation performed by the transfer unit based on the detection result of the environmental factor sensor.

4. The image forming apparatus of claim 3, further comprising:

a recording medium type information obtaining device configured to obtain recording medium type information indicating the type of the recording medium to be transferred to the transfer position, wherein only when at least one of the detection result of the environmental factor sensor and the recording medium type information satisfies a predetermined condition, the controller is configured to cause the image forming unit to form the releasing agent absorption toner image and to interrupt the transferring operation performed by the transfer unit.

5. The image forming apparatus of claim 4, wherein the controller is configured to obtain a duplex printed amount information indicating the accumulated number of duplex printed recording mediums, and when the duplex printed amount information reaches a threshold value, the controller stops the operation of transferring the recording medium to the transfer position, and to cause the image forming unit to form the releasing agent absorption toner image throughout all areas of the moving surface of the image carrier.

6. The image forming apparatus of claim 4, wherein the controller is configured to change an image forming condition of forming the releasing agent absorption toner based on at least one of the detection result of the environmental factor sensor and the recording medium type information.

7. The image forming apparatus of claim 6, wherein the image forming condition of forming the releasing agent absorption toner image is a size of the releasing agent absorption toner image in the direction of transferring the recording medium through the image carrier.

8. The image forming apparatus of claim 6, wherein the image forming condition of forming the releasing agent absorption toner image is a toner image forming frequency indicating how frequently the releasing agent absorption toner image is formed with respect to a plurality of in-between printed sides areas of the image carrier when the duplex printing is sequentially performed for a plurality of recording mediums.

9. The image forming apparatus of claim 8, further comprising:

a cleaning member use information obtaining device configured to obtain cleaning member use information indicating an accumulated use of the cleaning member, wherein when the duplex printing is sequentially performed for the plurality of recording mediums, the controller is configured to set the toner image forming frequency to a small value when the accumulated use of the cleaning member does not reach a threshold value and to set the toner image forming frequency to a large value when the accumulated use of the cleaning member reaches the threshold value.

10. The image forming apparatus of claim 9, further comprising:

a recording medium size information obtaining device configured to obtain recording medium size information indicating a size of the recording medium in the direction perpendicular to the direction of which the recording medium is transferred to the transfer position, wherein the controller is further configured to change a size of the releasing agent absorption toner image in the direction perpendicular to the direction of which the recording medium is transferred based on the recording medium size information.

11. The image forming apparatus of claim 10, wherein the wherein the recording medium size information obtaining device is an area information obtaining device configured to obtain recording medium area information indicating the area of the recording medium, and the controller is further configured to change a size of the releasing agent absorption toner image in the direction of which the recording medium is transferred based on the recording medium area information.

12. The image forming apparatus of claim 11, wherein, when the duplex printing is sequentially performed for the plurality of recording mediums, the controller is further configured to change the toner image forming frequency based on the recording medium area information.

13. The image forming apparatus of claim 12, wherein the releasing agent absorption toner image is a halftone toner image.

14. The image forming apparatus of claim 12, wherein the cleaning member is a cleaning blade having one end supported by a supporter at a fixed position and another end configured to freely move so as to be made in contact with the moving surface of the image carrier.

15. An image forming method performed by an image forming apparatus, the method comprising:

forming a toner image on a moving surface of an image carrier at an image forming position;

transferring the toner image formed on the moving surface of the image carrier to a recording medium at a transfer position while causing the recording medium to be in contact with the moving surface of the image carrier;

fixing the toner image on the recording medium while causing a fixing member to be in contact with the recording medium that is transferred from the transfer position;

re-transferring the recording medium transferred from the fixing member and having the toner image fixed on a first side thereof to the transfer position after reversing the first side of the recording medium so as to cause a second side of the recording medium to have an image formed and fixed thereon;

cleaning a portion of the moving surface of the image carrier which has passed the transfer position at which the toner image is transferred but before entering the image forming position at which the toner image is formed by causing a cleaning member to be in contact with the portion of the moving surface of the image carrier to remove toner from the portion of the moving surface;

switching between a single printing mode to form the toner image on the first side of the recording medium, and a duplex printing mode to re-transfer the recording medium and form the toner images on both of the first and second sides of the recording medium, according to an instruction received from an operator;

forming a releasing agent absorption toner image for absorbing the releasing agent on an in-between printed sides area of the moving surface of the image carrier when the instruction received from the operator selects the duplex printing mode, wherein the in-between printed sides area of the moving surface of the image carrier is at least one of:

a portion of the moving surface of the image carrier provided between a portion of the surface of the moving image carrier that is made in contact with the first side of the recording medium and a portion of the moving surface of the image carrier that is made in contact with the second side of the recording medium; and a portion of the moving surface of the image carrier provided between a portion of the moving surface of the image carrier that is made in contact with the second side of the recording medium and a portion of the moving surface of the image carrier that is made in contact with a first side of a following recording medium subsequently transferred after the recording medium, and interrupting the transferring operation of transferring the releasing agent absorption toner image from the image carrier to the recording medium when the in-between printed sides area of the moving surface of the image carrier enters the transfer position to keep the releasing agent absorption toner image on the in-between printed sides area of the moving surface of the image carrier even after the in-between printed sides area of the moving surface passes the transfer position.

16. The method of claim 15, further comprising:

detecting at least one of a temperature and a humidity to output a detection result, wherein the operation of forming the releasing agent absorption toner image and the operation of interrupting the transferring operation of transferring the toner image is performed based on the detection result of the environmental factor sensor.

17. A non-transitory computer readable recording medium including computer program instructions which cause a computer to execute an image forming method using an image forming apparatus, the method comprising:

forming a toner image on a moving surface of an image carrier at an image forming position;

transferring the toner image formed on the moving surface of the image carrier to a recording medium at a transfer position while causing the recording medium to be in contact with the moving surface of the image carrier;

fixing the toner image on the recording medium while causing a fixing member to be in contact with the recording medium that is transferred from the transfer position;

re-transferring the recording medium transferred from the fixing member and having the toner image fixed on a first side thereof to the transfer position after reversing the first side of the recording medium so as to cause a second side of the recording medium to have an image formed and fixed thereon;

cleaning a portion of the moving surface of the image carrier which has passed the transfer position at which the toner image is transferred but before entering the image forming position at which the toner image is formed by causing a cleaning member to be in contact with the portion of the moving surface of the image carrier to remove toner from the portion of the moving surface;

switching between a single printing mode to form the toner image on the first side of the recording medium, and a duplex printing mode to re-transfer the recording medium and form the toner images on both of the first and second sides of the recording medium, according to an instruction received from an operator;

forming a releasing agent absorption toner image for absorbing a releasing agent on an in-between printed sides area of the moving surface of the image carrier when the instruction received from the operator selects the duplex printing mode, wherein the in-between printed sides area of the moving surface of the image carrier is at least one of:

a portion of the moving surface of the image carrier provided between a portion of the surface of the moving image carrier that is made in contact with the first side of the recording medium and a portion of the moving surface of the image carrier that is made in contact with the second side of the recording medium; and a portion of the moving surface of the image carrier provided between a portion of the moving surface of the image carrier that is made in contact with the second side of the recording medium and a portion of the moving surface of the image carrier that is made in contact with a first side of a following recording medium subsequently transferred after the recording medium, and interrupting the transferring operation of transferring the releasing agent absorption toner image from the image carrier to the recording medium when the in-between printed sides area of the moving surface of the image carrier enters the transfer position to keep the releasing agent absorption toner image on the in-between printed sides area of the moving surface of the image carrier even after the in-between printed sides area of the moving surface passes the transfer position.

18. The medium of claim 17, wherein the image forming method further comprises:

detecting at least one of a temperature and a humidity to output a detection result, wherein the operation of forming the releasing agent absorption toner image and the operation of interrupting the transferring operation of transferring the toner image is performed based on the detection result of the environmental factor sensor.

* * * * *